US011510000B2

(12) United States Patent
Yazawa et al.

(10) Patent No.: US 11,510,000 B2
(45) Date of Patent: Nov. 22, 2022

(54) SOUND COLLECTION APPARATUS

(71) Applicant: NIPPON TELEGRAPH AND TELEPHONE CORPORATION, Tokyo (JP)

(72) Inventors: Sakurako Yazawa, Tokyo (JP); Kazunori Kobayashi, Tokyo (JP); Kenichi Noguchi, Tokyo (JP); Shoichiro Saito, Tokyo (JP)

(73) Assignee: NIPPON TELEGRAPH AND TELEPHONE CORPORATION, Tokyo (JP)

( * ) Notice: Subject to any disclaimer, the term of this patent is extended or adjusted under 35 U.S.C. 154(b) by 0 days.

(21) Appl. No.: 17/265,673

(22) PCT Filed: Jul. 25, 2019

(86) PCT No.: PCT/JP2019/029191
§ 371 (c)(1),
(2) Date: Feb. 3, 2021

(87) PCT Pub. No.: WO2020/031719
PCT Pub. Date: Feb. 13, 2020

(65) Prior Publication Data

US 2021/0321192 A1 Oct. 14, 2021

(30) Foreign Application Priority Data

Aug. 8, 2018 (JP) ..... JP2018-149269

(51) Int. Cl.
*H04R 1/40* (2006.01)
*H04R 1/34* (2006.01)
*H04R 5/027* (2006.01)

(52) U.S. Cl.
CPC ..... *H04R 1/406* (2013.01)

(58) Field of Classification Search
CPC ..... H04R 1/406; H04R 1/342; H04R 5/027; H04S 2400/15
(Continued)

(56) References Cited

U.S. PATENT DOCUMENTS

2005/0008170 A1* 1/2005 Pfaffinger ..... H04S 7/30 381/59
2011/0170728 A1* 7/2011 Chen ..... H04R 1/021 381/365
(Continued)

FOREIGN PATENT DOCUMENTS

EP 2773131 A1 9/2014
EP 3007461 A1 4/2016
(Continued)

OTHER PUBLICATIONS

Yazawa et al., "Objective Evaluation of an Acoustics system for Immersive Virtual Reality," 2018 ITE Annual Convention Program, published on Aug. 15, 2018 with its English translation generated by computer and its presentation material.

*Primary Examiner* — Thjuan K Addy

(57) ABSTRACT

A sound collection apparatus includes a substantially spherical base on which at least a predetermined number of recess portions are provided in a surface thereof with a predetermined interval therebetween; and a predetermined number of microphones. The predetermined number is an integer of 2 or greater. The microphones are installed on an inner bottom surface side of the recess portions one by one. Intervals between sound collecting portions of adjacent microphones are substantially equal to each other.

9 Claims, 36 Drawing Sheets

(58) Field of Classification Search
USPC ..... 381/92, 93, 94.1, 91, 95, 94.9, 71.1
See application file for complete search history.

(56) References Cited

U.S. PATENT DOCUMENTS

| | | | | |
|---|---|---|---|---|
| 2015/0055790 | A1* | 2/2015 | Kawakami | H04R 3/002 381/73.1 |
| 2015/0125011 | A1* | 5/2015 | Sekiya | H04S 7/307 381/307 |
| 2017/0347193 | A1 | 11/2017 | Marrin et al. | |
| 2018/0213323 | A1* | 7/2018 | Ohtsuka | H04R 1/1083 |

FOREIGN PATENT DOCUMENTS

| | | | |
|---|---|---|---|
| JP | 2014-45440 | A | 3/2014 |
| JP | 2016-082414 | A | 5/2016 |

* cited by examiner

SOUND COLLECTION APPARATUS

CROSS-REFERENCE TO RELATED APPLICATIONS

This application is a U.S. 371 Application of International Patent Application No. PCT/JP2019/029191, filed on 25 Jul. 2019, which application claims priority to and the benefit of JP Application No. 2018-149269, filed on 8 Aug. 2018, the disclosures of which are hereby incorporated herein by reference in their entireties.

TECHNICAL FIELD

The present invention relates to a sound collecting technology, and more particularly, to a technology for observing sound arriving from a plurality of directions.

BACKGROUND ART

PTL 1 discloses a technology in which an acoustic array apparatus (sound collection apparatus) configured by a plurality of microphones is used to estimate and extract information on any target sound source (target sound source signal and position) by linear filtering.

CITATION LIST

Patent Literature

[PTL 1] Japanese Patent Application Laid-open No. 2016-82414

SUMMARY OF THE INVENTION

Technical Problem

A large number of microphones are necessary in order to collect sound in all directions by the sound collection apparatus in PTL 1. On the other hand, when the interval between adjacent microphones is narrow, the phase difference of sound observed by the microphones and emitted from the same sound source is small, and estimation and extraction accuracy (that is, resolution) of information on a target sound source decreases. When the intervals between adjacent microphones is increased in order to improve the accuracy, the sound collection apparatus is upsized.

The present invention has been made in view of the above, and it is an object thereof to accurately collect sound in all directions without increasing the size of a sound collection apparatus so much.

Means for Solving the Problem

The present invention provides a sound collection apparatus, including: a substantially spherical base on which at least N recess portions are provided in a surface thereof with a predetermined interval therebetween; and N microphones. N is an integer of 2 or greater. The microphones are installed on an inner bottom surface side of the recess portions one by one, and intervals between the sound collecting portions of adjacent microphones are substantially equal.

Effects of the Invention

Consequently, sound in all directions can be accurately collected without increasing the size of a sound collection apparatus so mush.

DESCRIPTION OF EMBODIMENTS

Figure 1:
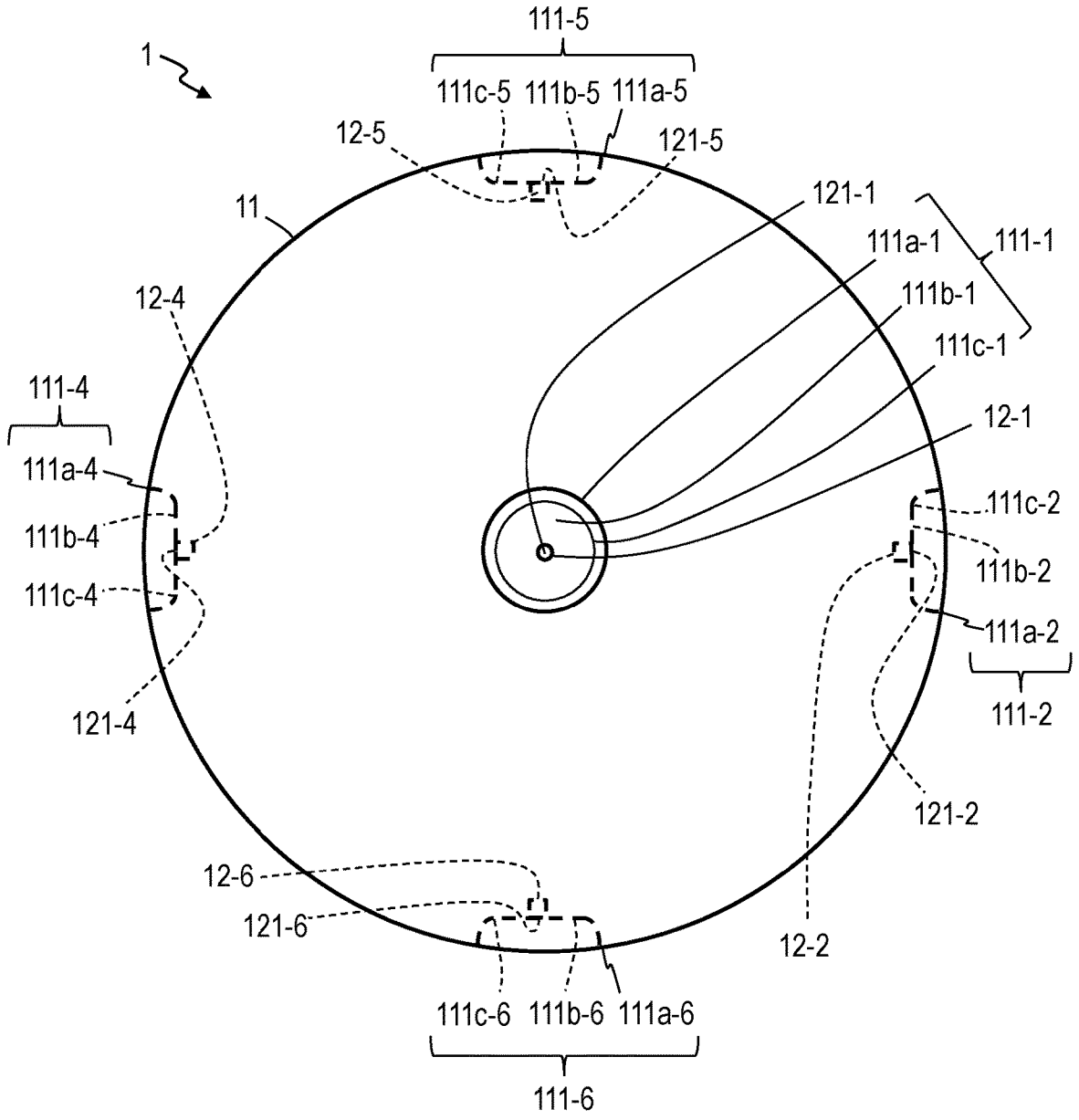
FIG. 1 is a front view for exemplifying a sound collection apparatus in a first embodiment.

Referring to the drawings, embodiments of the present invention are described below.

First Embodiment

Figure 2:
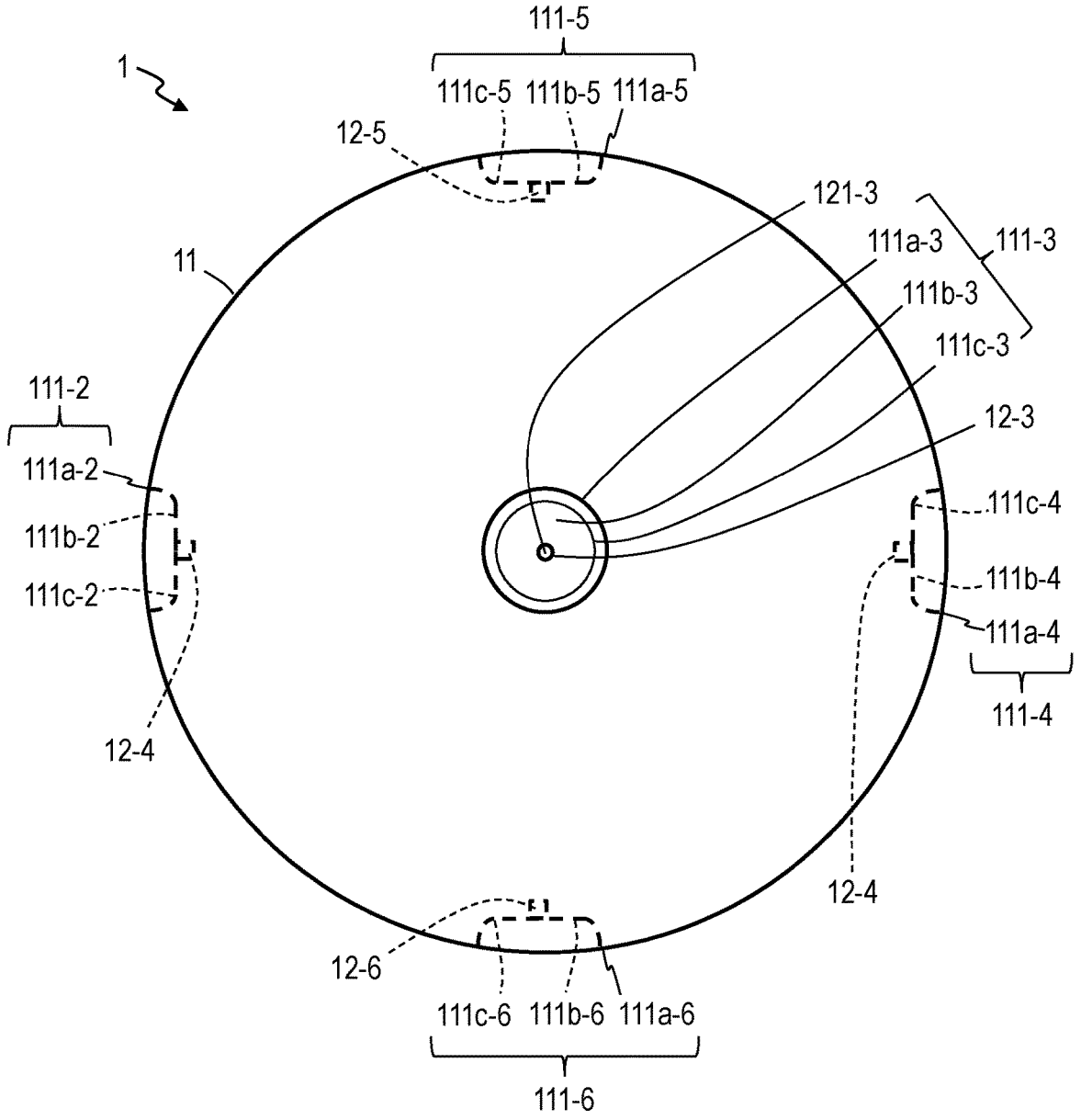
FIG. 2 is a rear view for exemplifying the sound collection apparatus in the first embodiment.

FIG. 1 and FIG. 2 exemplify a front view and a rear view of a sound collection apparatus 1 in the present embodiment, respectively. As exemplified in FIG. 1 and FIG. 2, the sound collection apparatus 1 in the present embodiment has a substantially spherical base 11 on which N recess portions 111-1, . . . , 111-N are provided on its surface with predetermined intervals therebetween, and N microphones 12-1, . . . , 12-N. A substantial sphere means a three-dimensional object (substantial sphere) that is not strictly a sphere but has a shape similar to a sphere. Examples of the substantial sphere include a three-dimensional object of which surface shapes of parts other than the recess portions 111-1, . . . , 111-N match or substantially match the surface shape of a sphere. The number of recess portions 111-1, . . . , 111-N is, for example, N, which is the same as the number of microphones 12-1, . . . , 12-N. N is an integer of 2 or greater. An example in which N=6 is illustrated in the first embodiment, which is not intended to limit the present invention. For example, the base 11 is made of material that sufficiently reflects sound (for example, synthetic resin, metal, and wood).

Figure 3A:
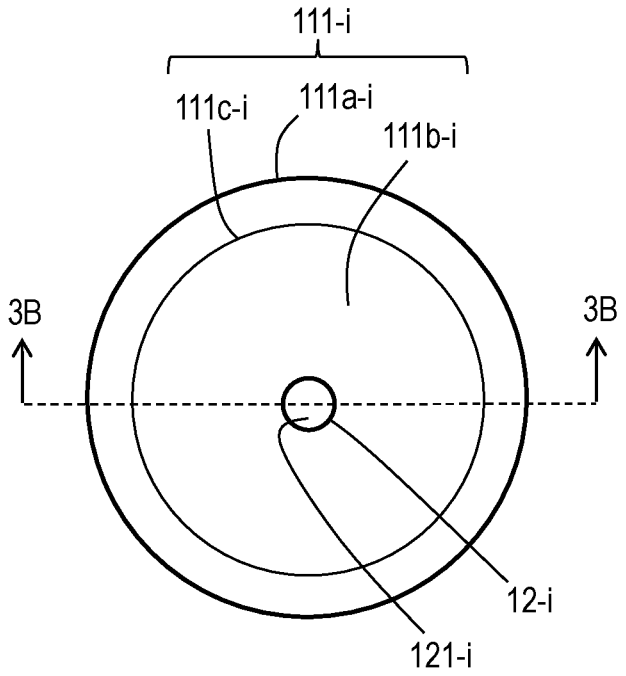
FIG. 3A is a plan view for exemplifying recess portions in the first embodiment.
Figure 3B:
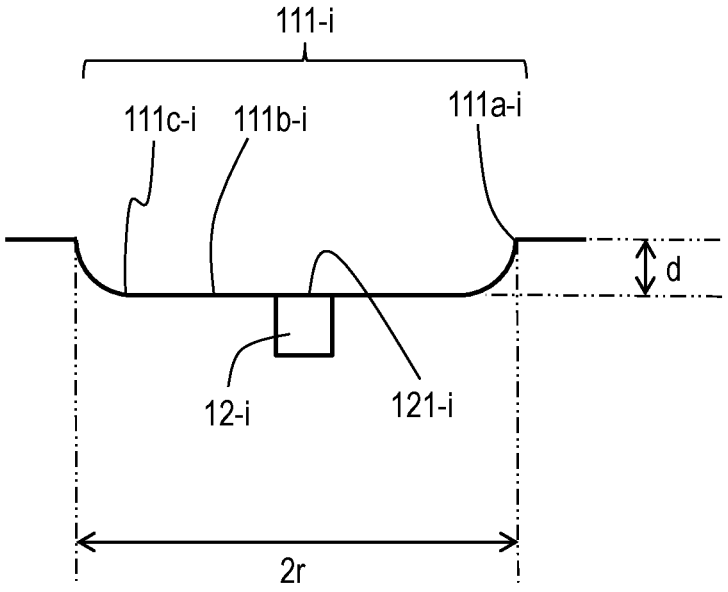
FIG. 3B is a cross-sectional view taken along the line 3B-3B in FIG. 3A.

FIG. 3A is a plan view for exemplifying the recess portion 111-*i* (i=1, N) in the present embodiment. FIG. 3B is a cross-sectional view taken along the line 3B-3B in FIG. 3A. As exemplified in FIG. 3A and FIG. 3B, the recess portion 111-*i* exemplified in the present embodiment is a recess having a dish-shaped inner wall surface shape. In other words, the shape of an edge portion 111*a*-*i* on an open end side (surface side) of the recess portion 111-*i* exemplified in the present embodiment is substantially circular. An inner bottom surface 111*b*-*i* of the recess portion 111-*i* (inner bottom surface of recess portion 111-*i*) is a substantially flat surface of a substantially circle (edge portion 111*c*-*i* of inner bottom surface 111*b*-*i* is substantially flat surface of substantially circle). A substantially circle means a circle or a shape near a circle (substantially circle). Examples of the shape near a circle include an oval in which the ratio of the major axis to the minor axis is a predetermined value γ1 or smaller, and is a line-symmetric or point-symmetric polygon. γ1 is a real number larger than 1. γ1 is, for example, 1.1, 1.2, 1.3, 1.4, or 1.5. A substantially flat surface means a flat surface or a surface near a flat surface (substantially flat surface). A substantially flat surface may be, for example, a surface with slight unevenness, or may be a surface slightly curved. The diameter (for example, diameter) $D_{in}$ of the edge portion 111*c*-*i* of the inner bottom surface 111*b*-*i* is equal to or smaller than the diameter (for example, diameter) $D_{out}$ of the edge portion 111*a*-*i* of the recess portion 111-*i* on the open end side. For example, $D_m$ is shorter than $D_{out}$. A region between the edge portion 111*a*-*i* and the edge portion 111*c*-*i* is the inner wall surface of the recess portion 111-*i*. In the example in FIG. 3A and FIG. 3B, $D_{in}$ is less than $D_{out}$. The inner wall surface between the edge portion 111*a*-*i* and the edge portion 111*c*-*i* is formed into a slope shape and smoothly connected to the inner bottom surface 111*b*-*i*. It is desired that the depth d of the recess portion 111-*i* be less than a half of the diameter (for example, diameter) $D_{out}$ of the edge portion 111*a*-*i* of the open end of the recess portion 111-*i*. For example, as exemplified in FIG. 3B, it is desired that the depth d of the recess portion 111-*i* be less than a half of the diameter $D_{out}$=2r of the edge portion 111*a*-*i* of the open end of the recess portion 111-*i* (0<d<r). The reason is that the resolution can be improved (details are described later). $D_{out}$ and $D_{in}$ are larger than the diameter (for example, diameter) of the sound collecting portions 121-*i* of the microphones 12-1, . . . , 12-N. An example of $D_{out}$ and $D_{in}$ is twice or near twice the diameter (for example, diameter) of the sound collecting portions 121-*i* of the microphones 12-1, . . . , 12-N. Note that the sound collecting portion 121-*i* is a site including a mechanism for converting air vibration of sound into an electric signal (for example, diaphragm or metallic foil). For example, the sound collecting portion 121-*i* is provided on one end side of the microphone 12-*i*. An example of d is 2 mm. It is desired that the shapes of N recess portions 111-1, . . . , 111-N be substantially equal (equal or substantially equal) to each other. In this manner, sound collection variation depending on the sound arrival direction can be reduced. As exemplified in FIG. 1 and FIG. 2, the recess portions 111-1, . . . , 111-N are provided with predetermined intervals, and the edge portions 111*a*-1, . . . , 111*a*-N on the open end side are away from each other. In other words, the recess portions 111-1, . . . , 111-N are provided at positions that do not interfere with each other, and are independent from each other. In this manner, the resolution can be improved, and sound collection variation depending on the sound arrival direction can be reduced.

As exemplified in FIG. 1, FIG. 2, FIG. 3A, and FIG. 3B, the microphones 12-*i* (i=1, . . . , N) are installed (fixed) on the inner bottom surface 111*b*-*i* side of the recess portions 111-*i* (i=1, . . . , N) one by one. Intervals (distances) between sound collecting portions 121-*i* of adjacent microphones 12-*i* are substantially equal to each other. In other words, the intervals between the sound collecting portions 121-*i* of adjacent microphones 12-*i* are a predetermined value or its vicinity. In the case of the example in FIG. 1 and FIG. 2, the intervals between each sound collecting portion 121-*i* and four other adjacent sound collecting portions 121-*i'* are substantially equal to each other. For example, the interval between the sound collecting portion 121-1 and the sound collecting portion 121-2, the interval between the sound collecting portion 121-1 and the sound collecting portion 121-4, the interval between the sound collecting portion 121-1 and the sound collecting portion 121-5, and the interval between the sound collecting portion 121-1 and the sound collecting portion 121-6 are all substantially equal to each other (FIG. 1). Note that the state in which α and β are substantially equal to each other means that α and β are equal or α and β are substantially equal to each other. The state in which α and β are substantially equal to each other means that the difference $\delta=|\alpha-\beta|$ between α and β is 0% or greater and γ2% or smaller with respect to α. γ2 is, for example, 1, 3, 5, 10, 20, 30, 40, or 50. In the case of the example in FIG. 1 and FIG. 2, the sound collecting portion 121-*i* provided on one end side of the microphone 12-*i* is disposed on the inner bottom surface 111*b*-*i* side of each recess portion 111-*i*, and the distal end or the vicinity of the distal end of each sound collecting portion 121-*i* is disposed on the same plane as the inner bottom surface 111*b*-*i*. As exemplified in FIG. 3A and FIG. 3B, it is desired that the sound collecting portion 121-*i* of each microphone 12-*i* be disposed at the center of the inner bottom surface 111*b*-*i* of each recess portion 111-*i* or in the vicinity of the center of the inner bottom surface 111*b*-*i*. In other words, it is desired that the sound collecting portion 121-*i* of each microphone 12-*i* be disposed at positions at substantially the same distance from the inner wall surface between the edge portion 111*a*-*i* and the edge portion 111*c*-*i*. In this manner, the improvement of the resolution can be expected. Note that the state in which the sound collecting portion 121-*i* is disposed near a means, for example, a state in which the sound collecting portions 121-*i* are disposed at positions at which a deviation width of the sound collecting portion 121-*i* from a is γ3% or smaller of the diameter (for example, diameter) of the sound collecting portion 121-*i*. γ3 is, for example, 1, 3, 5, 10, 20, 30, 40, or 50.

To set the intervals between the sound collecting portions 121-*i* of adjacent microphones 12-*i* to be substantially equal, for example, the sound collecting portions 121-*i* of the microphones 12-*i* only need to be disposed one by one at vertices of a regular polyhedron having N vertices or the vicinities of the vertices. In a sphere circumscribed by all vertices of a regular n-hedron, the microphones 12-*i* are disposed at the vertex parts to secure the uniformity. As regular polyhedrons, there are only a regular tetrahedron, a regular hexahedron, a regular octahedron, a regular dodecahedron, and a regular icosahedron. The relations of constituent faces, the number of faces, the number of edges, and the number of vertices of regular polyhedrons are described below.

TABLE 1

| Regular polyhedron | Constituent faces | Number of faces | Number of edges | Number of vertices (N) |
|---|---|---|---|---|
| Regular tetrahedron | Equilateral triangle | 4 | 6 | 4 |
| Regular hexahedron | Square | 6 | 12 | 8 |
| Regular octahedron | Equilateral triangle | 8 | 12 | 6 |
| Regular dodecahedron | Equilateral pentagon | 12 | 30 | 20 |
| Regular icosahedron | Equilateral triangle | 20 | 30 | 12 |

Figure 4A:
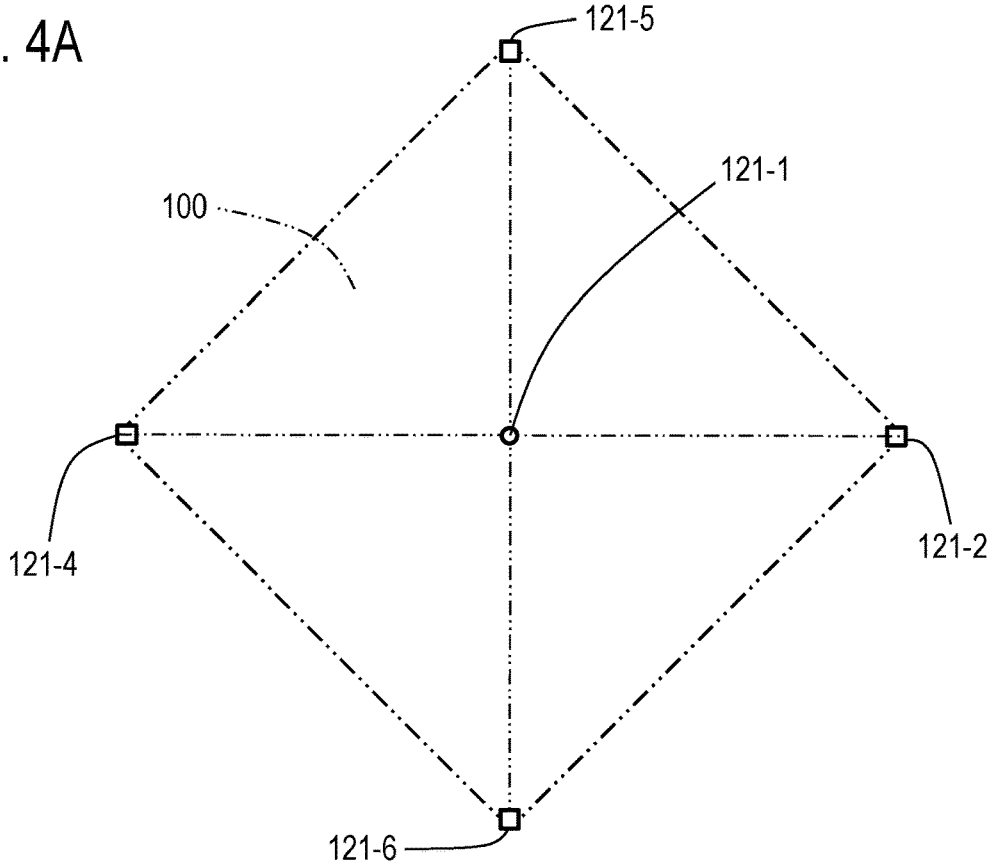
FIG. 4A is a front view for exemplifying the arrangement of microphones in the first embodiment.
Figure 4B:
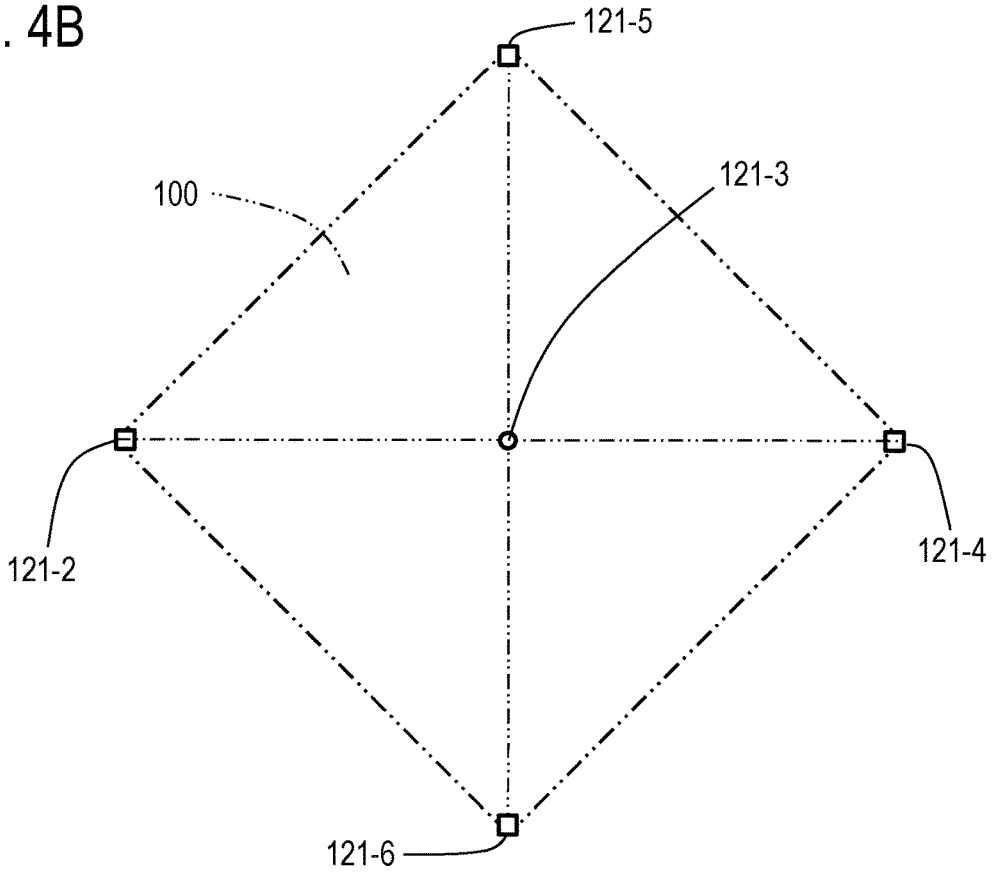
FIG. 4B is a rear view for exemplifying the arrangement of microphones in the first embodiment.
Figure 5:
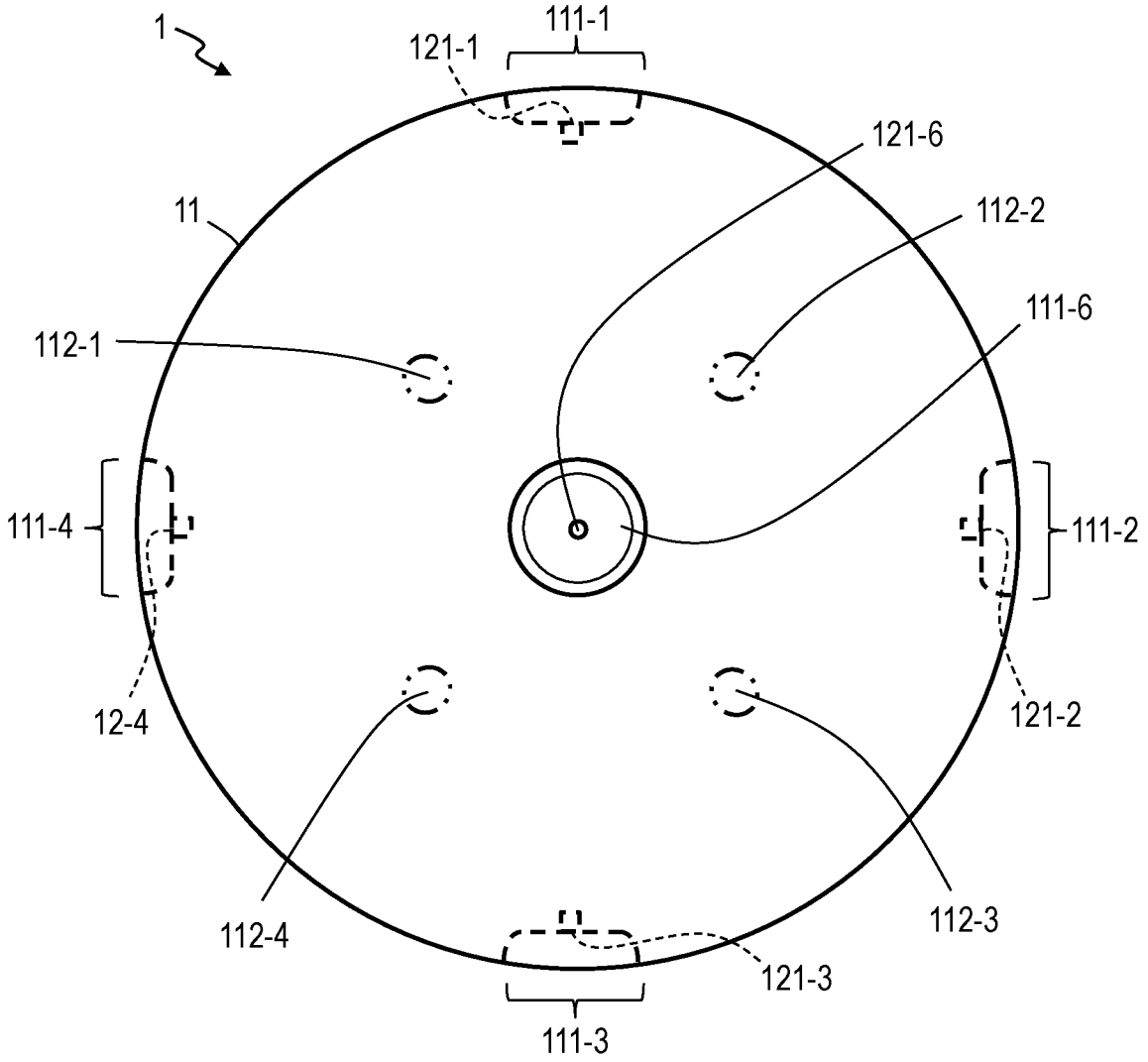
FIG. 5 is a bottom view for exemplifying the sound collection apparatus in the first embodiment.

As described above, when the sound collecting portions 121-*i* are disposed at vertices of a regular polyhedron or in the vicinities of the vertices one by one, N is any of 4, 6, 8, 12, and 20. FIG. 4A and FIG. 4B exemplify a front view and a rear view illustrating the positional relation of the sound collecting portions 121-*i* exemplified in FIG. 1 and FIG. 2. As exemplified in FIG. 4A and FIG. 4B, in the case of the example in FIG. 1 and FIG. 2, the sound collecting portions 121-*i* (i=1, . . . , 6) of the microphones 12-*i* may be disposed at vertices of a regular polyhedron (regular octahedron) 100 having six vertices or in the vicinities of the vertices one by one. The sound collecting portion 121-*i* disposed at each vertex or its vicinity is disposed, for example, in a direction from the center of the regular polyhedron toward the vertex or its vicinity.

Figure 6:
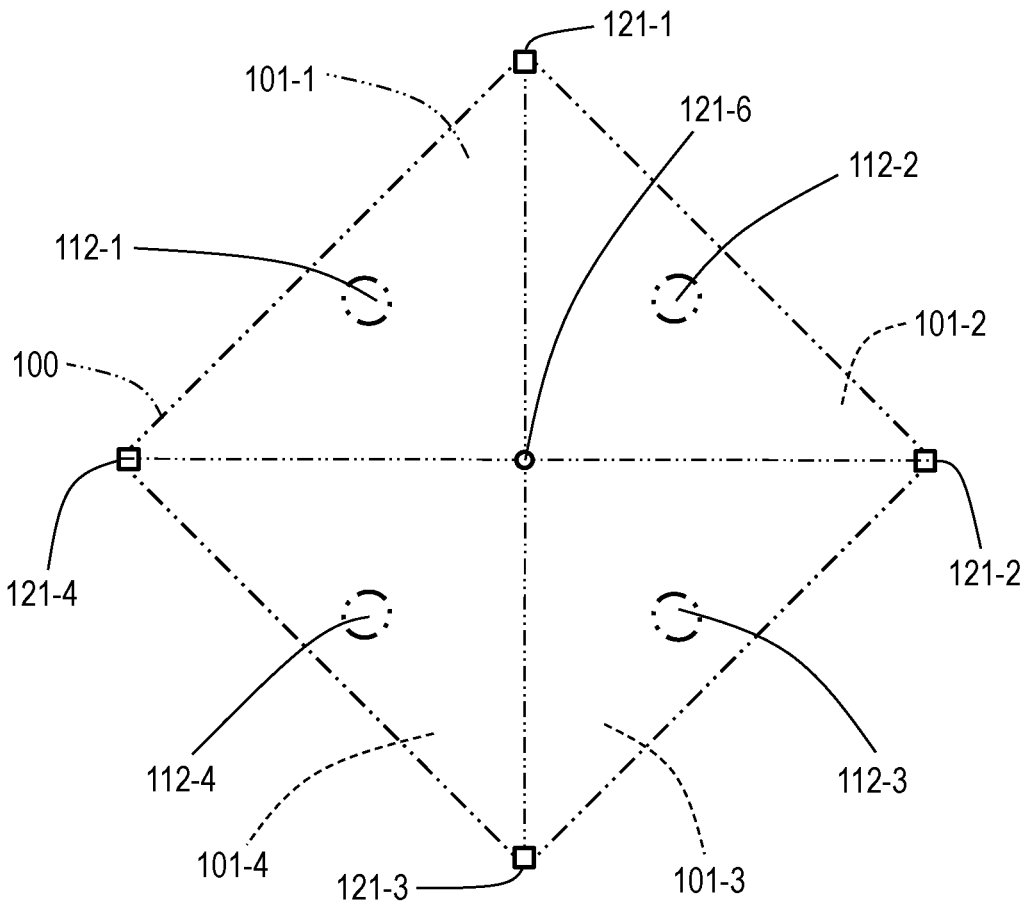
FIG. 6 is a bottom view for exemplifying the arrangement of support regions in the first embodiment.
Figure 7:
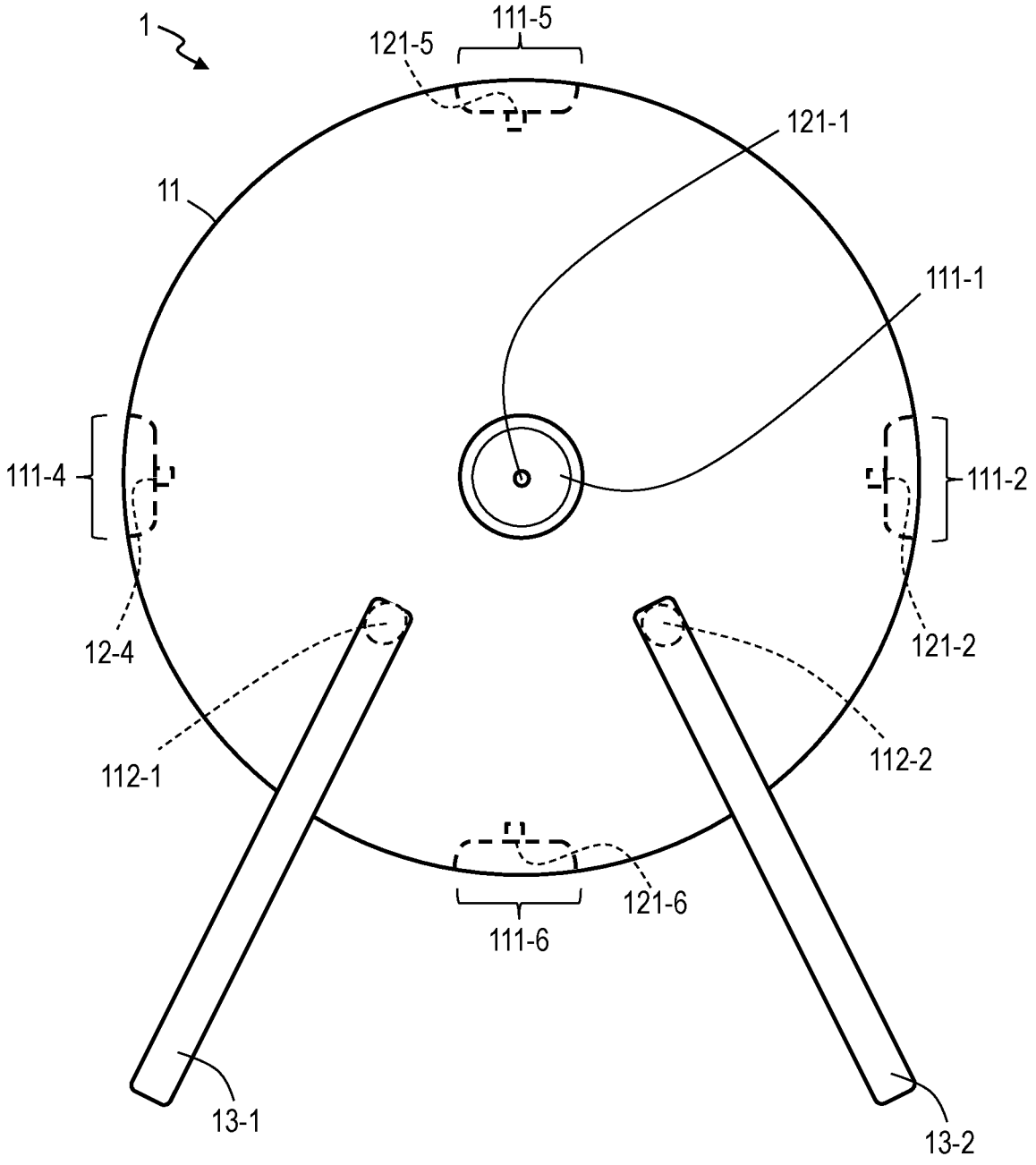
FIG. 7 is a front view for exemplifying how columnar support members are mounted in support regions in the first embodiment.
Figure 8:
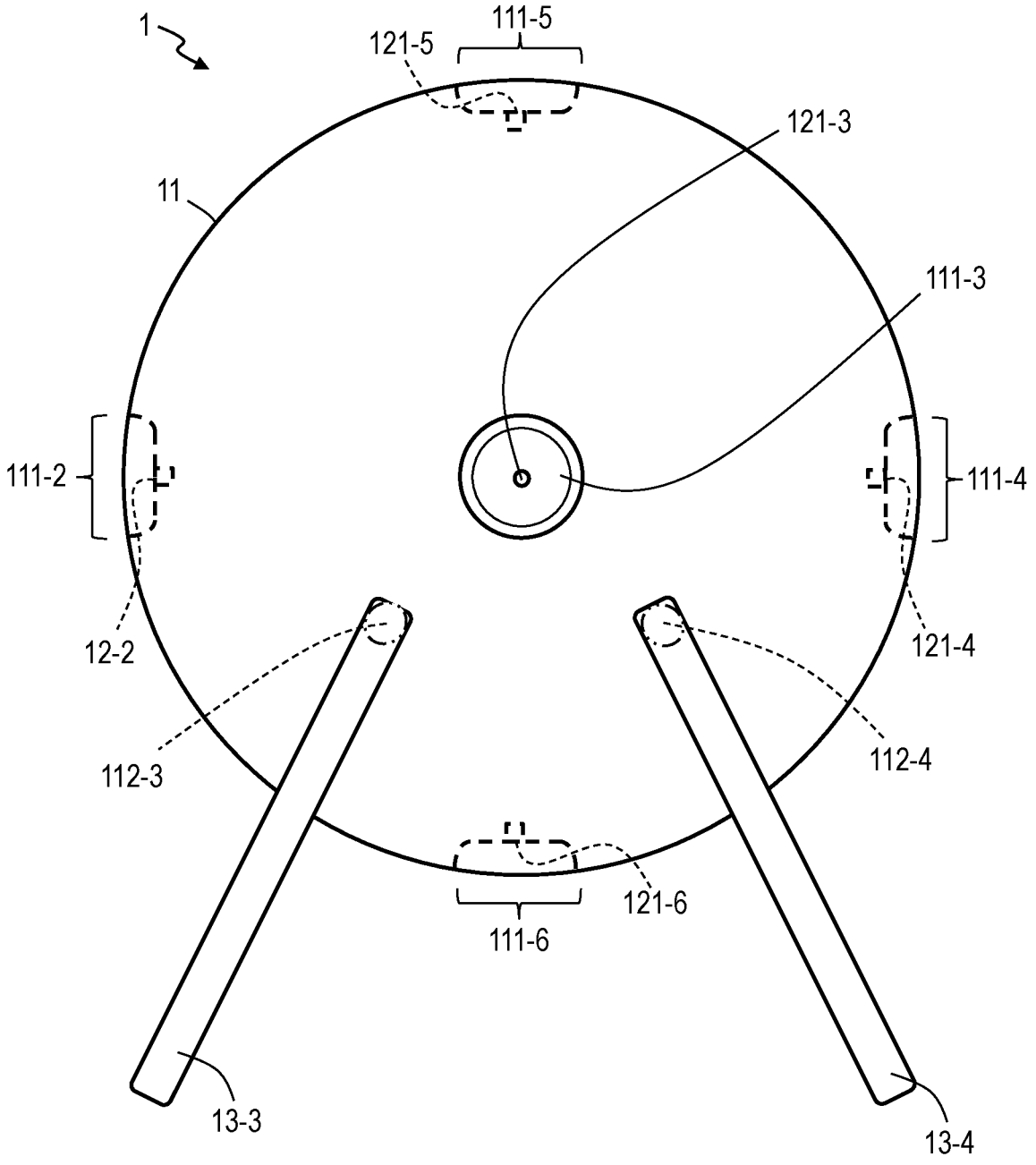
FIG. 8 is a rear view for exemplifying how the columnar support members are mounted in the support regions in the first embodiment.

As exemplified in FIGS. 5 to 8, the sound collection apparatus 1 may have a support member 13-*j* (j=1, . . . , M) that supports the base 11 from the lower side (side where support member 13-*j* is disposed when base 11 is disposed). M is an integer of 1 or more. The case where M=4 is exemplified in FIGS. 5 to 8, which is not intended to limit the present invention. Each support member 13-*j* supports a support region 112-*j* located on the lower side of the base 11. For example, one end of each support member 13-*j* is mounted in the support region 112-*j*, and the base 11 is supported from the lower side. When the base 11 is supported by the support member 13-*j*, the presence of the support member 13-*j* may affect spatial environments, which may adversely affect sound received by a microphone 12-*i* present near the support member 13-*j*. When there is an adverse effect on observation of sound arriving from the target sound source direction, there is also an adverse effect on estimation and extraction accuracy of information on a target sound source. It is desired that the support member 13-*j* support the base 11 from the side where a target sound source is not present, thereby reducing the adverse effect. In general, a target sound source is not present below the base 11 in many cases. Thus, when the base 11 is supported from the lower side, the adverse effect can be expected to be suppressed to be lower than when the base 11 is supported from the upper side or from the horizontal direction. It is desired that the intervals between each support region 112-*j* and the sound collecting portion 121-*i* of the microphone 12-*i* adjacent to the support region 112-*j* (present around support region 112-*j*) be substantially uniform. Note that being substantially uniform means being uniform or substantially uniform. In other words, it is desired that the support region 112-*j* be provided at substantially the same distance from the sound collecting portions 121-*i* of microphones 12-*i* adjacent thereto. For example, in the case of the example in FIG. 5 and FIG. 6, it is desired that the support region 112-1 be disposed at substantially the same distance from the sound collecting portions 121-1, 121-4, and 121-6, the support region 112-2 be disposed at substantially the same distance from the sound collecting portions 121-1, 121-2, and 121-6, the support region 112-3 be disposed at substantially the same distance from the sound collecting portions 121-2, 121-3, and 121-6, and the support region 112-4 be disposed at substantially the same distance from the sound collecting portions 121-3, 121-4, and 121-6. For example, when the sound collecting portions 121-*i* are disposed at vertices of the regular polyhedron 100 or in the vicinities of the vertices one by one, it is desired that the support region 112-*j* be provided on a face 101-*j* (j=1, . . . , M) present on the lower side of the regular polyhedron 100 (side where face is disposed on lower side when base 11 is disposed), and the support region 112-*j* be disposed such that the distances from all vertices of the face 101-*j* to the support region 112-*j* are substantially equal (FIG. 6). In this manner, the effects of the support members 13-*j* on observation by the sound collecting portions 121-*i* disposed around the support region 112-*j* can be made uniform to further suppress the above-mentioned adverse effect. Note that the shape of the support member 13-*j* is not limited, and, for example, a rod-shaped support member 13-*j* may be used. Note that, when it is desired that the shapes of the support members 13-*j* be substantially the same. In this manner, the effects of the support members 13-*j* on sound observed by the sound collecting portions 121-*i* can be made uniform to further suppress the above-mentioned adverse effect.

Second Embodiment

Figure 9:
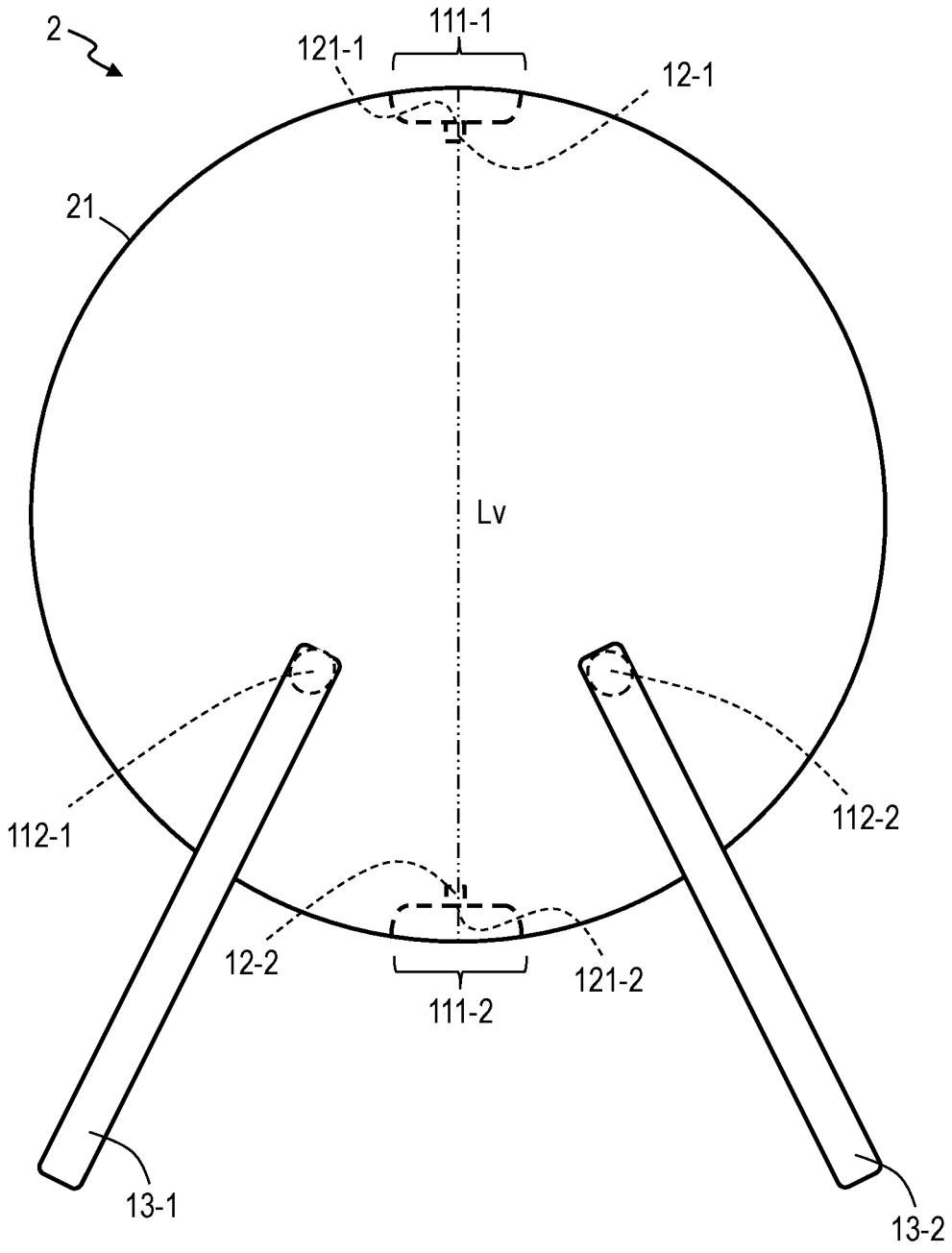
FIG. 9 is a front view for exemplifying a sound collection apparatus in a second embodiment.
Figure 10:
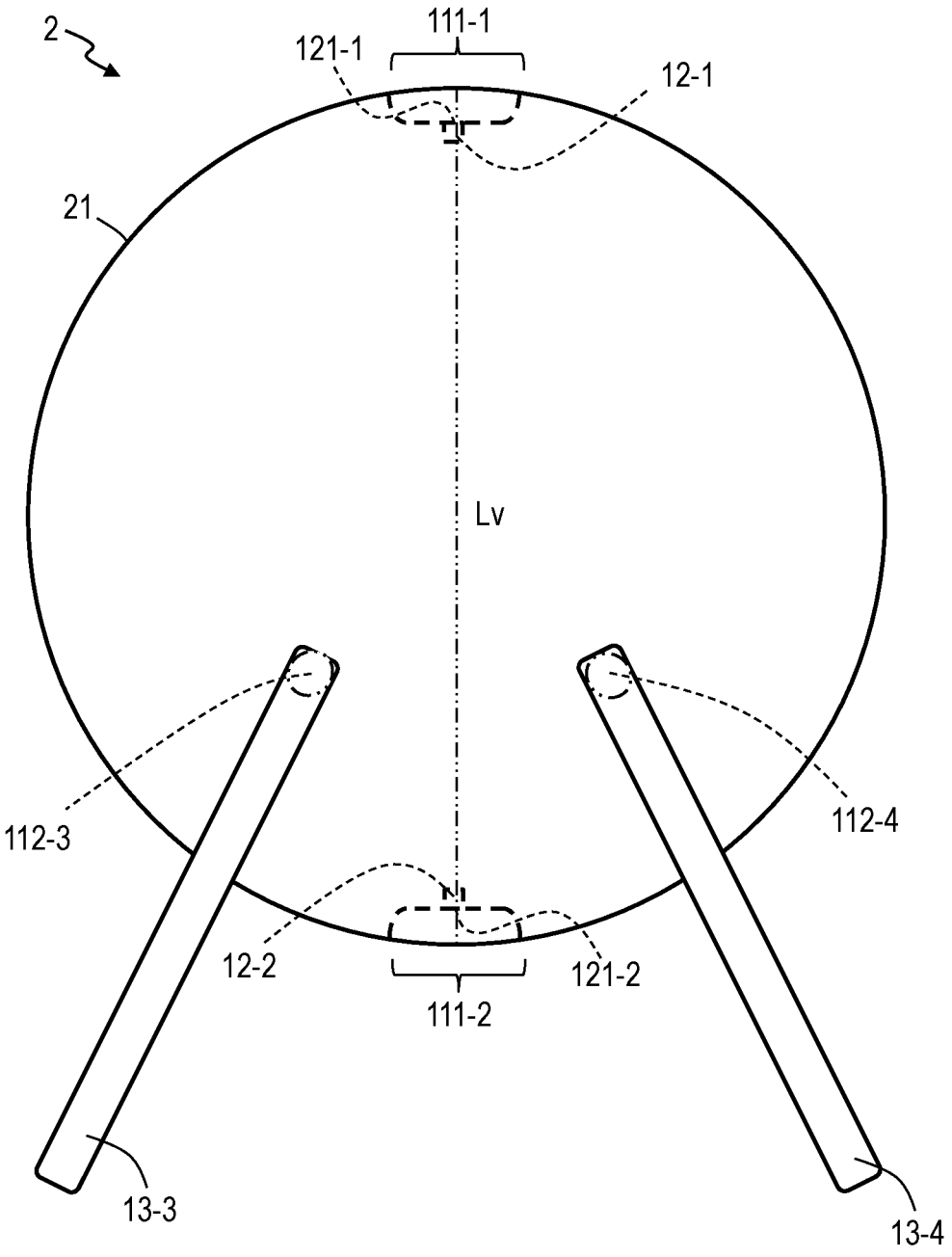
FIG. 10 is a rear view for exemplifying the sound collection apparatus in the second embodiment.

In the first embodiment, an example in which the sound collecting portions 121-*i* of the microphones 12-*i* are disposed one by one at vertices of a regular polyhedron having N vertices or in the vicinities of the vertices in order to set the intervals between the sound collecting portions 121-*i* of adjacent microphones 12-*i* to be substantially equal to each other has been described. There is no regular polyhedron having two vertices, but when N=2, the sound collecting portions 121-*i* of the microphones 12-*i* (i=1,2) only need to be disposed on a straight line passing through the center of the base or the vicinity of the center of the base. FIG. 9 and FIG. 10 exemplify a front view and a rear view of a sound collection apparatus 2 having such a configuration, respectively. Differences from the matters described above are mainly described below, and the matters already described above are denoted by the same reference symbols to simplify descriptions thereof.

As exemplified in FIG. 9 and FIG. 10, a sound collection apparatus 2 in a second embodiment includes a substantially spherical base 21 on which two recess portions 111-1 and 111-2 are provided in its surface with a predetermined interval therebetween, two microphones 12-1 and 12-2, and support members 13-*j* (j=1, . . . , M) that support the base 21. The case where M=4 is exemplified in FIG. 9 and FIG. 10, which is not intended to limit the present invention. For example, M=3 or ≥5 may be established. The recess portions 111-1 and 111-2 are provided on a straight line Lv (on vertical axis) passing through the center of the base 21 or the vicinity of the center of the base 21. The recess portion 111-1 is provided on the upper side of the base 21, and the recess portion 111-2 is provided on the lower side of the base 21. The microphones 12-*i* (i=1,2) are installed (fixed) on the inner bottom surface 111*b*-*i* side of the recess portions 111-*i* (i=1,2) one by one. In this case, each sound collecting portion 121-*i* (i=1,2) is disposed on the straight line Lv. The interval between the sound collecting portion 121-1 and the sound collecting portion 121-2 disposed in this manner is substantially the same even when measured in any direction. Each support member 13-*j* (j=1, . . . , M) supports the support region 112-*j* located on the lower side of the base 21, and supports the base 21 from the lower side. It is desired that the distances from the sound collecting portion 121-2 disposed on the lower side of the base 21 to the support regions 112-*j* be substantially equal to each other. In this manner, the effect of sound arriving at the sound collecting portion 121-2 from each direction on each support region 112-*j* can be made uniform.

Third Embodiment

Figure 11:
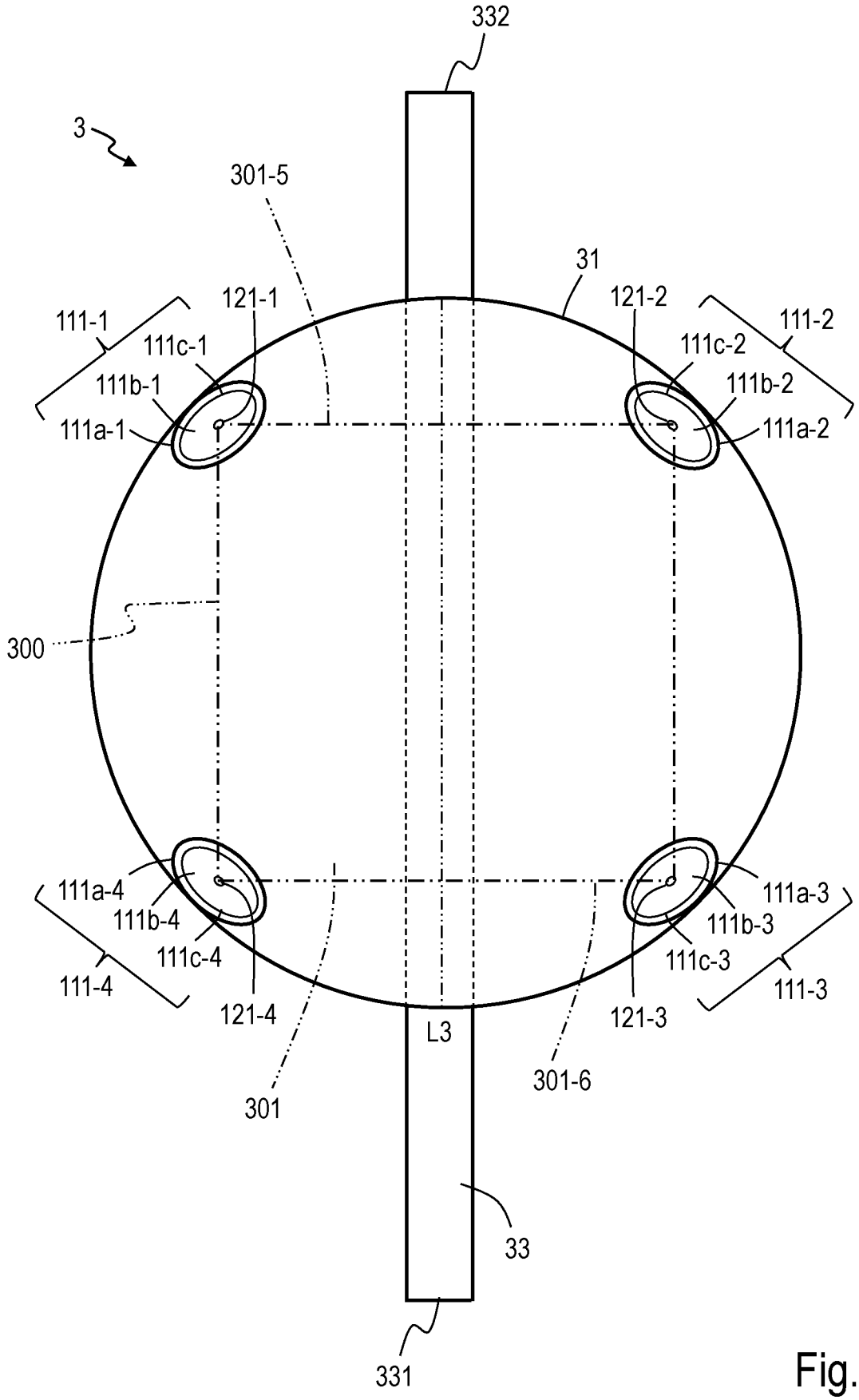
FIG. 11 is a front view for exemplifying a sound collection apparatus in a third embodiment.
Figure 12:
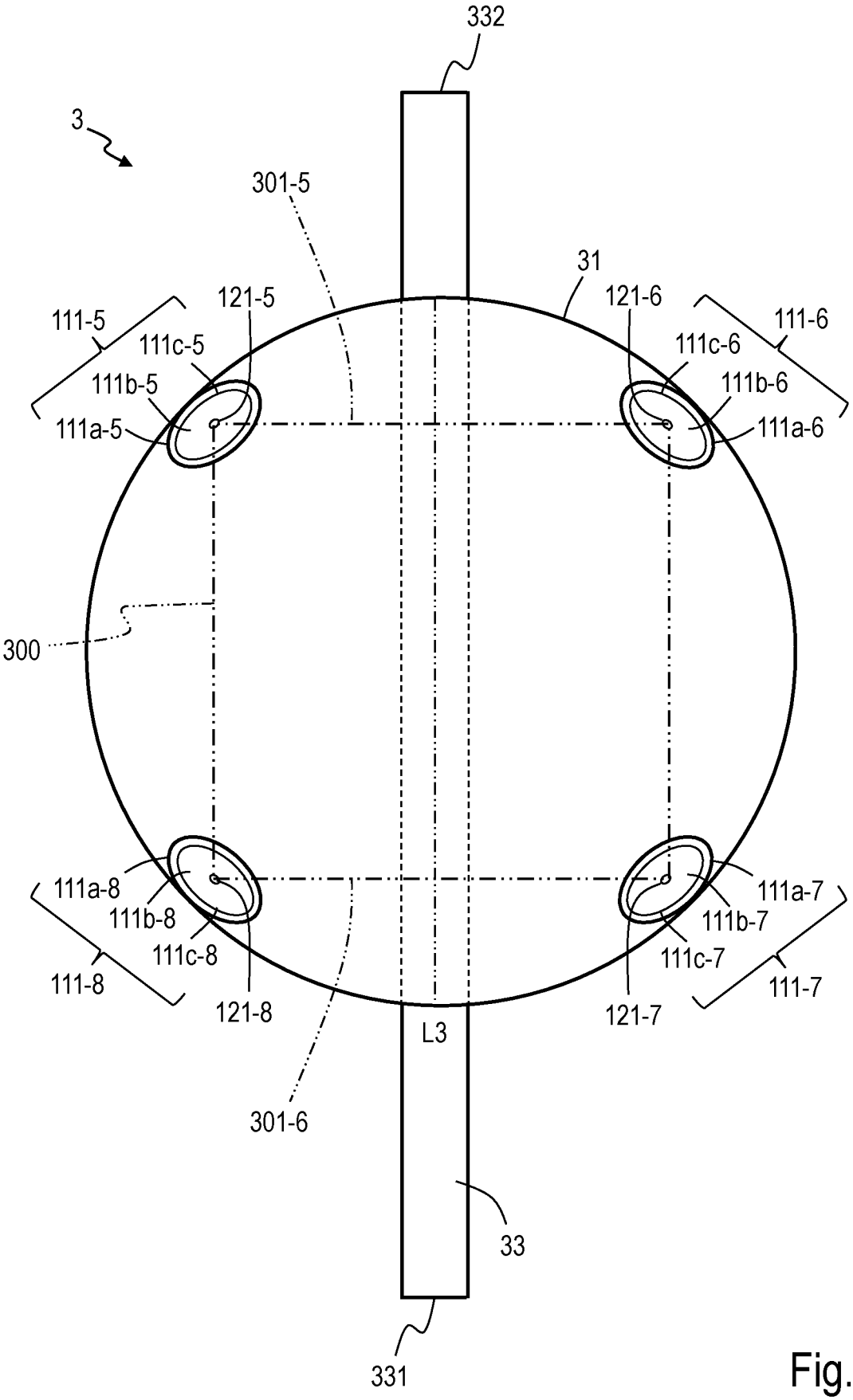
FIG. 12 is a rear view for exemplifying the sound collection apparatus in the third embodiment.
Figure 13:
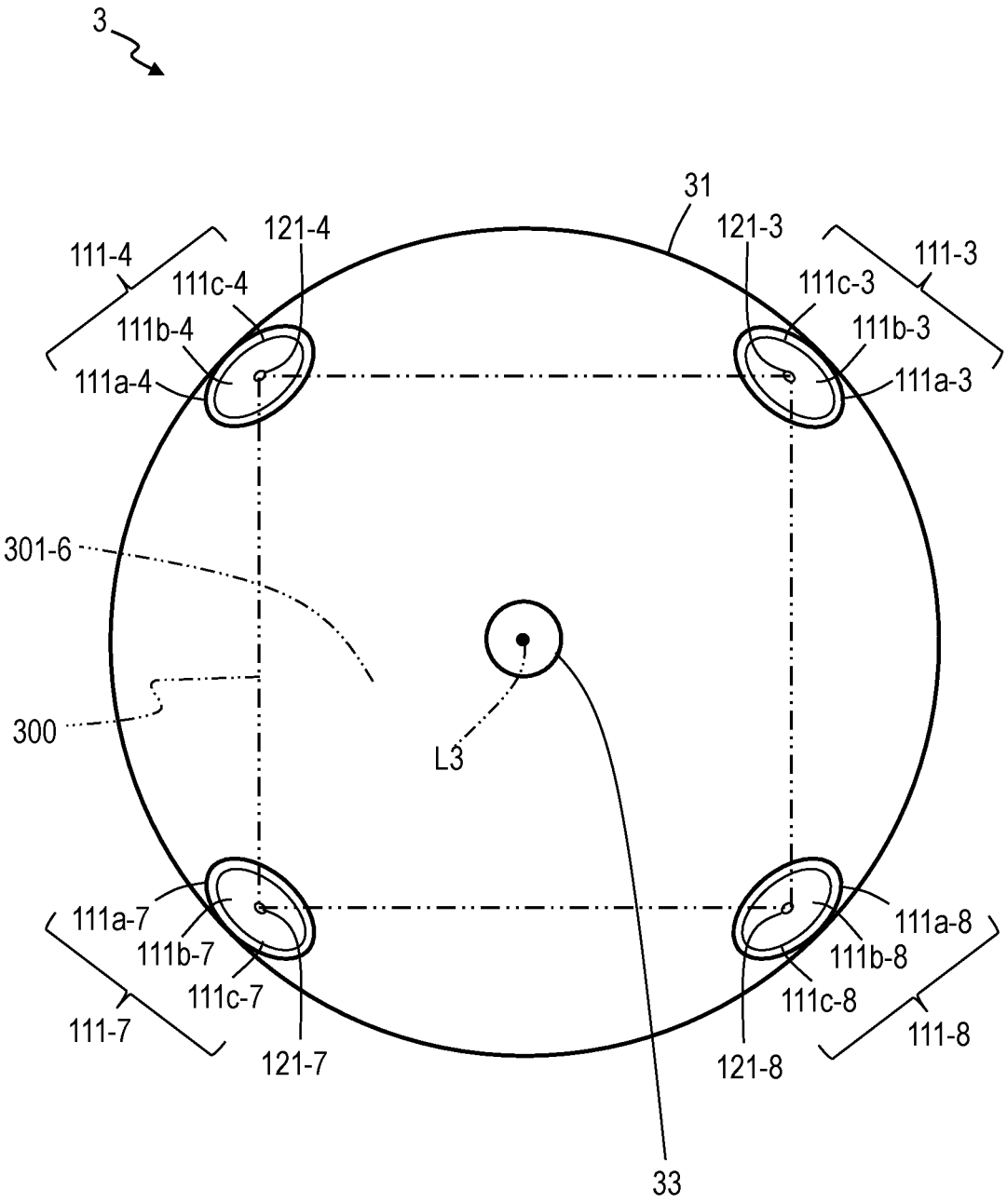
FIG. 13 is a bottom view for exemplifying the sound collection apparatus in the third embodiment.

A third embodiment is a modification of the first embodiment, and is different from the first embodiment in that a rod-shaped support member is fixed to a base while passing through the base. FIG. 11, FIG. 12, and FIG. 13 exemplify a front view, a rear view, and a bottom view of a sound collection apparatus 3 in the third embodiment, respectively. As exemplified in FIG. 11 and FIG. 13, the sound collection apparatus 3 in the third embodiment includes a substantially spherical base 31 on which N recess portions 111-*i* (i=1, . . . , N) are provided in a surface thereof with a predetermined interval therebetween, N microphones 12-1, . . . , 12-N, and a rod-shaped support member 33 fixed to a base 31 while passing through the base 31. Note that the case of N=8 is exemplified in FIG. 11 to FIG. 13, but the present invention is not limited thereto.

The distances from a part 331 on one side of the support member 33 disposed outside the base 31 to sound collecting portions 121-3, 121-4, 121-7, and 121-8 of microphones disposed near the part 331 are substantially equal to each other. Similarly, the distances from a part 332 on the other side of the support member 33 disposed outside the base 31 to sound collecting portions 121-1, 121-2, 121-5, and 121-6 of microphones disposed around the part 332 are substantially equal to each other. For example, N is any of 6, 8, 12, and 20, the sound collecting portions 121-*i* (i=1, . . . , N) of the microphones are disposed at vertices of a regular polyhedron 300 having N vertices or in the vicinities of the vertices one by one, and the support member 33 is disposed on a straight line L3 (third straight line) passing through the vicinity of the centers of a pair of parallel faces 301-5 and 301-6 of the regular polyhedron 300 or the vicinity of the centers of a pair of faces 301-5 and 301-6 thereof. In this manner, the distances from the part 331 to the sound collecting portions of the microphones disposed around the part 331 are equal to each other, and the distances from the part 332 to the sound collecting portions of the microphones disposed around the part 332 are equal to each other. As a result, the adverse effect based on the support member 33 as described above in the first embodiment can be reduced. Further, the part 331 of the support member 33 can be fixed to the ground or gripped by a user, and a camera can be mounted to the part 332 of the support member 33.

Fourth Embodiment

Figure 14:
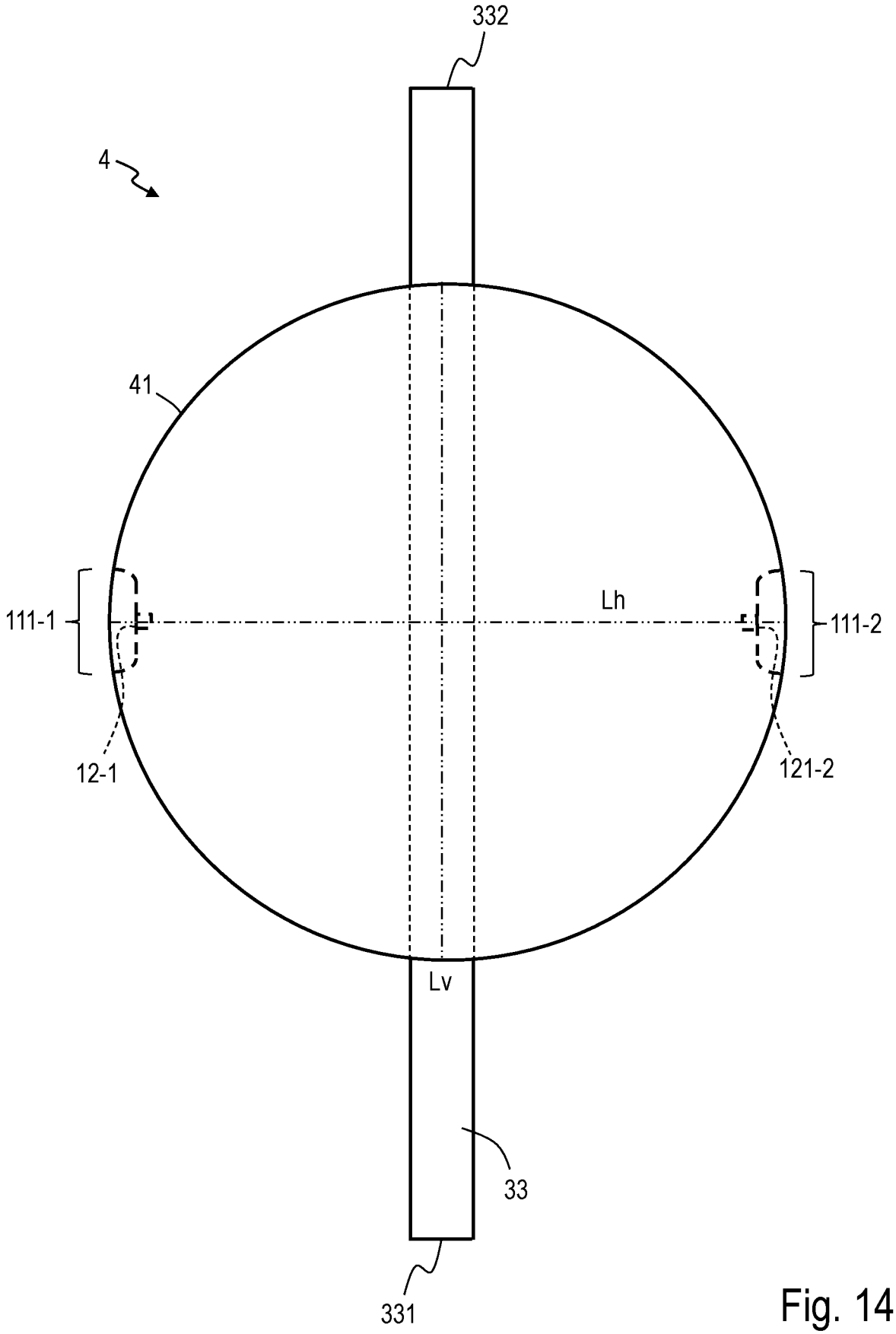
FIG. 14 is a front view for exemplifying a sound collection apparatus in a fourth embodiment.
Figure 15:
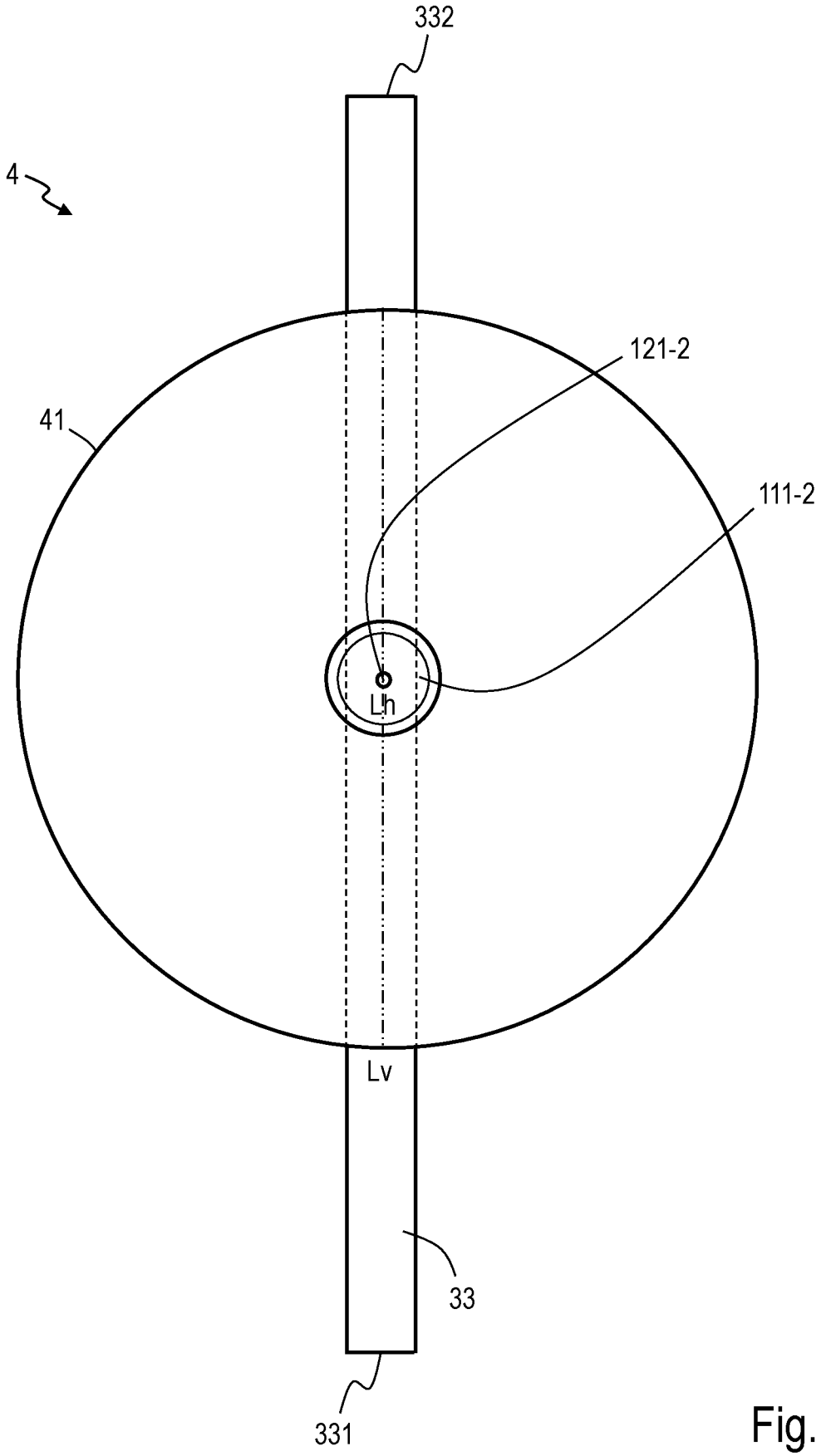
FIG. 15 is a right side view for exemplifying the sound collection apparatus in the fourth embodiment.

A fourth embodiment is a modification of the second and third embodiments. In the present embodiment, N=2 and a rod-shaped support member is fixed to a base while passing through the base. FIG. 14 and FIG. 15 exemplify a front view and a right side view of a sound collection apparatus 4 in the fourth embodiment. As exemplified in FIG. 14 and FIG. 15, the sound collection apparatus 4 in the fourth embodiment has a substantially spherical base 41 on which two recess portions 111-*i* (i=1,2) are provided on its surface with a predetermined interval therebetween, two microphones 12-1 and 12-2, and a rod-shaped support member 33 fixed to the base 41 while passing through the base 41. Distances from a part 331 on one side of the support member 33 disposed outside the base 41 to the sound collecting portions 121-1 and 121-2 of the microphones are substantially equal to each other. Similarly, distances from a part 332 on the other side of the support member 33 disposed outside the base 41 to the sound collecting portions 121-1 and 121-2 of the microphones are substantially equal to each other. For example, the sound collecting portions 121-1 and 121-2 of the microphones are disposed on a straight line Lh (first straight line) passing through the center of the base 41 or the vicinity of the center of the base 41, and the support member 33 is disposed on a straight line Lv (second straight line) passing through the center of the base 41 or the vicinity of the center of the base and substantially orthogonal to the straight line Lh (first straight line). For example, the straight line Lh is a straight line along the horizontal direction, and the straight line Lv is a straight line along the vertical direction. Note that being substantially orthogonal means being orthogonal or being substantially orthogonal. In this manner, the distances from the part 331 to the sound collecting portions 121-1 and 121-2 of the microphones are equal to each other, and the distances from the part 332 to the sound collecting portions 121-1 and 121-2 of the microphones are equal to each other. As a result, the adverse effect based on the support member 33 as described above in the first embodiment can be reduced.

Usage Example of Sound Collection Apparatus

Figure 16:
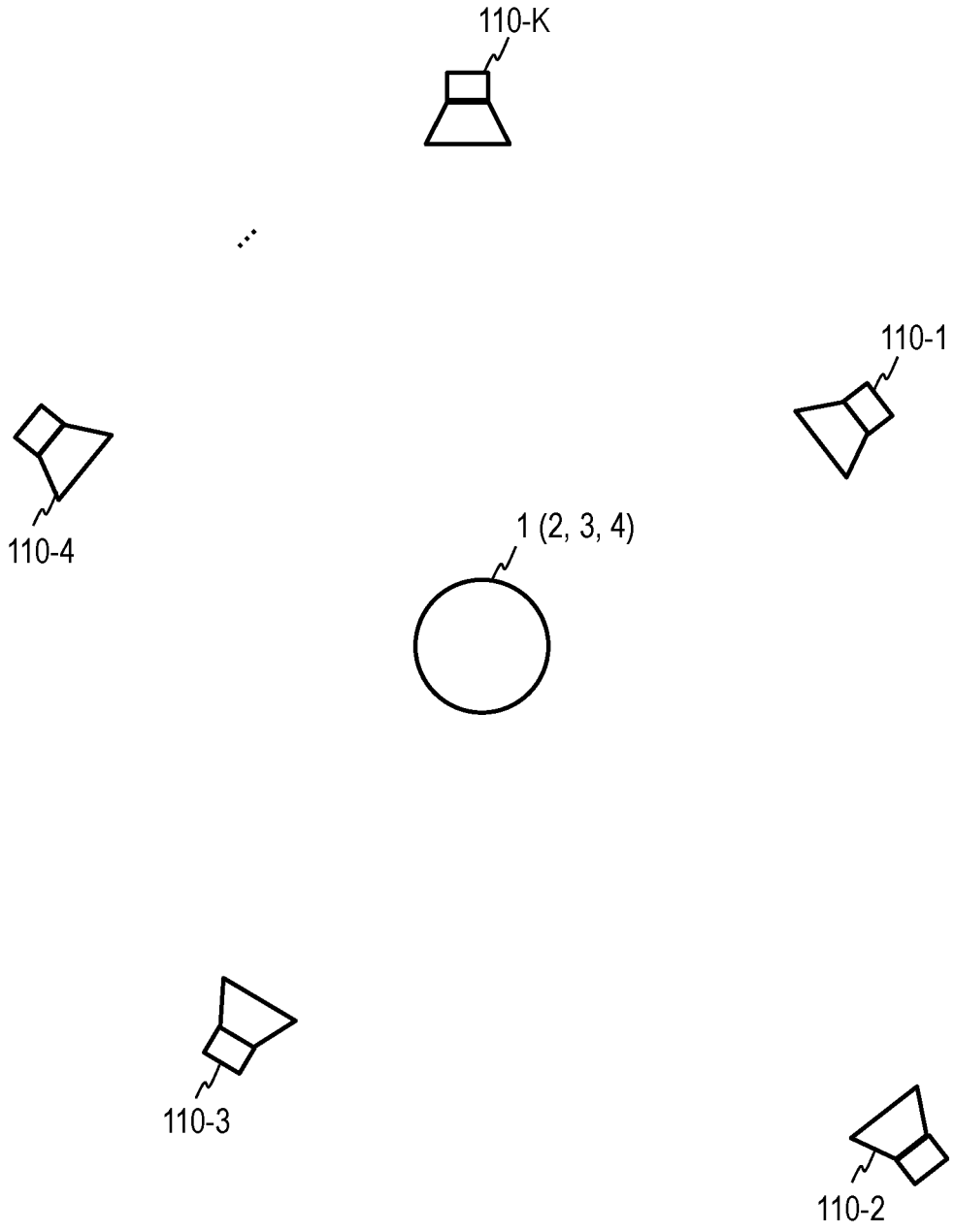
FIG. 16 is a view for exemplifying how the sound collection apparatus is disposed inside a plurality of sound sources.

Next, an example of estimating and extracting information on a target sound source by linear filtering by using the above-mentioned sound collection apparatuses 1 to 4 is described (see, for example, PTL 1, etc.). As exemplified in FIG. 16, K sound sources 110-1, . . . , 110-K and the sound collection apparatus 1 are disposed in a space. The sound collection apparatus 1 is used here as an example, but the other sound collection apparatuses 2 to 4 may be used. In this environment, the following relation can be approximated.

[Formula 1] (1)

$$\begin{bmatrix} Y_1(\omega,\tau) \\ \vdots \\ Y_K(\omega,\tau) \end{bmatrix} = \begin{bmatrix} W_{1,1}(\omega) & \dots & W_{1,M}(\omega) \\ \vdots & \ddots & \vdots \\ W_{K,1}(\omega) & \dots & W_{K,M}(\omega) \end{bmatrix} \begin{bmatrix} X_1(\omega,\tau) \\ \vdots \\ X_K(\omega,\tau) \end{bmatrix}$$

where $X_i(\omega,\tau)$ (i=1, . . . , M) represents an observed signal in a time frequency domain obtained by converting an observed signal (mixed signal) in a time domain observed by the microphone 12-*i* into a time frequency domain (for example, short-time Fourier transform). ω and τ represent indices of angular frequency and frame time, respectively. $Y_k(\omega,\tau)$ represents a sound source signal in a time frequency domain obtained by converting a sound source signal in a time domain emitted from the sound source 110-*k* (k=1, . . . , K) into a time frequency domain. $W_{k,i}$ represents an element of a linear filter. For example, environments where particular sound (for example, impulse) is emitted from only a particular sound source 110-I are observed by the sound collection apparatus 1 in advance (for example, impulse response is observed) to obtain $X_i(\omega,\tau)$ (i=1, . . . , M), and $X_i(\omega,\tau)$ and $Y_k(\omega,\tau)$ (k=1, . . . , K) corresponding to the state in which only particular sound is generated from only the particular sound source 110-I are substituted into Equation (1) to solve simultaneous equations, thereby obtaining $W_{k,i}$ for extracting sound emitted from the particular sound source 110-I (target sound source). By performing the same calculation while the sound sources 110-1, . . . , 110-K are regarded as the sound source 110-I, $W_{k,i}$ for the sound sources 110-1, . . . , 110-K as target sound sources can be obtained. By determining $W_{k,i}$ in advance in this manner, an estimated value of $Y_I(\omega,\tau)$ of a particular sound source 110-I (I∈{1, . . . , K}) (target sound source) can be calculated from $X_i(\omega,\tau)$ corresponding to an observed signal (mixed signal) in a time domain observed by the microphone 12-*i* in accordance with Equation (1) above.

Figure 17A:
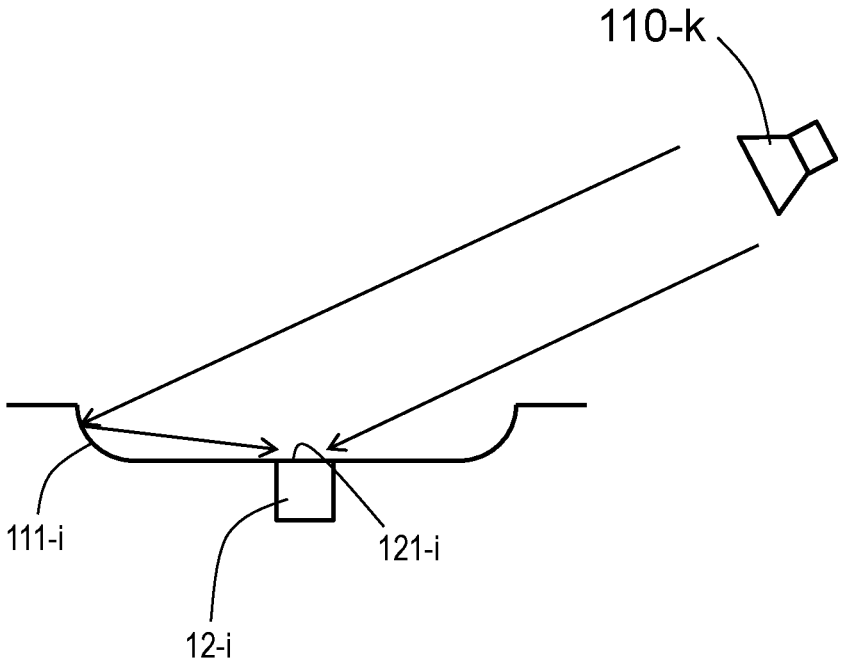
FIG. 17A and FIG. 17B are cross-sectional views for exemplifying how sound generated from a sound source is observed in the embodiments.
Figure 17B:
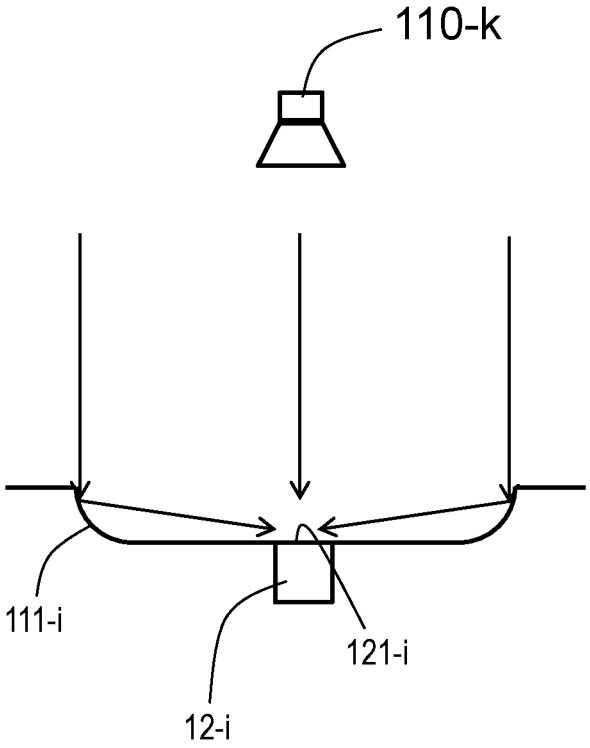

By using the above-mentioned sound collection apparatus 1 (2, 3, 4), sound emitted from any target sound source can be extracted with resolution higher than the conventional one. In other words, as exemplified in FIG. 17A and FIG. 17B, not only direct sound emitted from the sound source 110-*k* but also sound reflected by the inner wall surface of the recess portion 121-*i* reaches the sound collecting portion 121-*i* of the microphone 12-*i*. In this manner, more information on sound emitted from the sound source 110-*k* can be collected without increasing the number of microphones 12-*i* per unit area. By suppressing the number of microphones 12-*i* per unit area, the phase difference in sound emitted from the same sound source 110-*k* observed by adjacent microphones 12-*i* can be sufficiently detected. As a result, the estimation and extraction accuracy of information on a target sound source can be expected to improve. Owing to the function of the recess portion 121-*i*, each microphone 12-*i* can acquire much sound information, and hence the number of microphones 12-*i* can be suppressed to downsize the sound collection apparatus.

Figure 18:
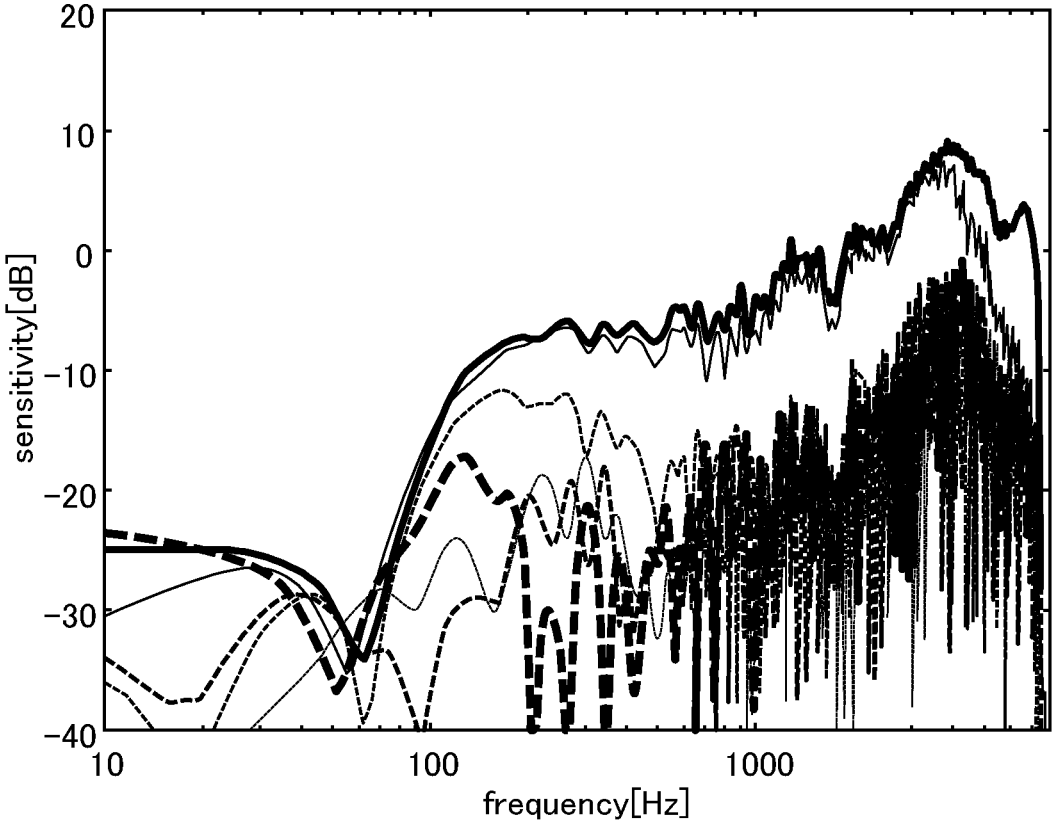
FIG. 18 is a graph exemplifying a relation between the shape of a recess portion and sensitivity at each frequency.

FIG. 18 exemplifies sensitivity when a linear filter calculated as described above by using the sound collection apparatus 1 is used to perform linear filtering to obtain an estimated value of $Y_k(\omega,\tau)$ of each sound source 110-*k*. The horizontal axis represents the frequency, and the vertical axis represents the sensitivity. Note that the sensitivity represents the level [dB] of the estimated value of $Y_k(\omega,\tau)$ with reference to actual $Y_k(\omega,\tau)$. The thick solid line in FIG. 18 indicates sensitivity of an estimated value of $Y_1$ (ω, T) of a target sound source, and the thin solid line indicates sensitivity of an estimated value of $Y_{k'}(\omega,\tau)$ of another sound source present at a position at which the direction as seen from the sound collection apparatus 1 deviates from the target sound source by 30 degrees. In other words, the thick solid line indicates sensitivity of target sound source components to be extracted (components of sound emitted from target sound source), and the thin solid line indicates sensitivity of components of a sound source adjacent to the target sound source (components of sound emitted from the sound source). The broken lines indicate sensitivity of estimated values of $Y_{k''}(\omega,\tau)$ of other sound sources. k',k"∈{1, . . . , K}. In other words, the broken lines indicate sensitivity of sound source components to be suppressed. As exemplified in FIG. 18, it is understood that by using the sound collection apparatus 1, components other than the target sound source components to be extracted are sufficiently suppressed from a low range (particularly, around 100 Hz) to a high range.

Figure 19:
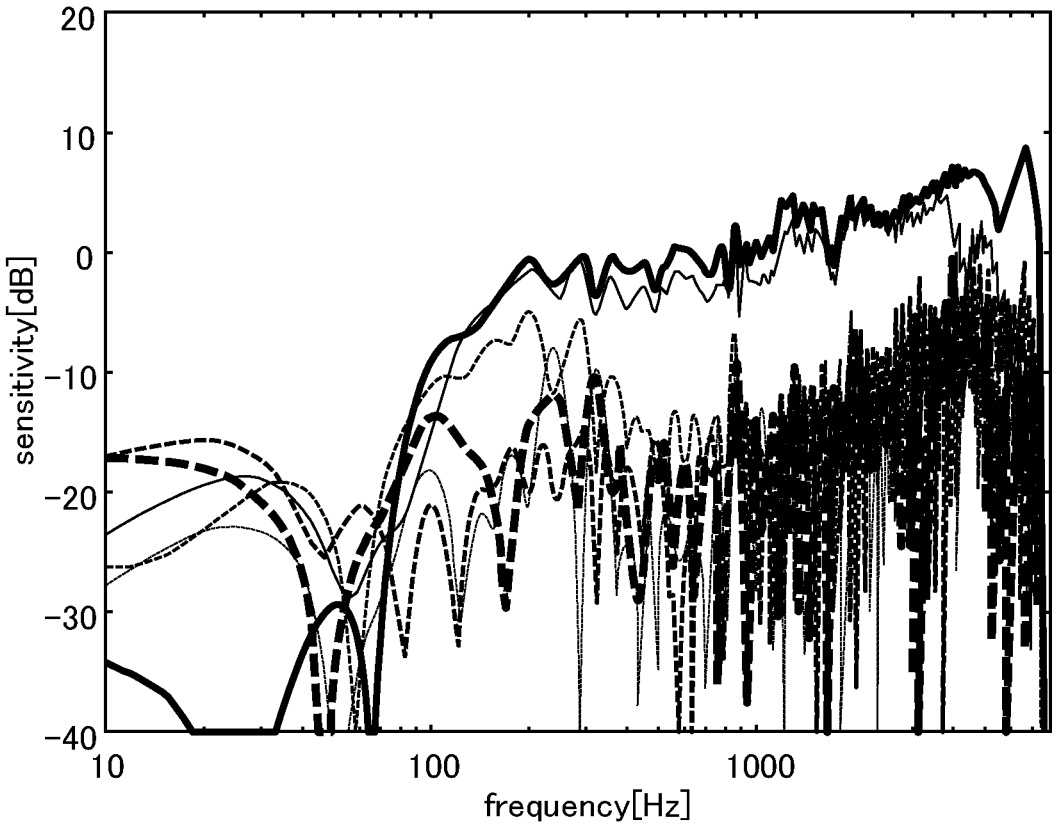
FIG. 19 is a graph exemplifying a relation with sensitivity at each frequency when a sound collection apparatus without a recess portion is used.

FIG. 19 exemplifies sensitivity when a linear filter calculated as described above by using, instead of the sound collection apparatus 1, a sound collection apparatus in which microphones are disposed on the surface of a sphere without recess portions is used to perform linear filtering to obtain an estimated value of $Y_k(\omega,\tau)$ of each sound source 110-*k*. As exemplified in FIG. 19, in this case, it is understood that components other than the target sound source components are not sufficiently suppressed particularly on the low range side.

As described above, it is understood that by using the sound collection apparatus 1, the estimation and extraction accuracy of information on a target sound source is improved as compared with the case where the sound collection apparatus in which microphones are disposed on the surface of a sphere without recess portions.

CONCLUSION

As described above, the sound collection apparatuses 1 to 4 in the respective embodiments have the substantially spherical bases 11 to 41 on which at least N recess portions are provided in a surface thereof with a predetermined interval therebetween, and N microphones 12-1 to 12-N. N is an integer of 2 or greater. The microphones 12-1 to 12-N are installed on the inner bottom surface side of the recess portions 111-1 to 111-N one by one, and the intervals between the sound collecting portions 121-1 to 121-N of adjacent microphones 12-1 to 12-N are substantially equal. As described above, owing to the function of the recess portion 121-*i*, sound emitted from any target sound source can be extracted with resolution higher than the conventional one. When the intervals between the sound collecting portions 121-1 to 121-N of the microphones 12-1 to 12-N are too small, the resolution decreases, but when the intervals between the sound collecting portions 121-1 to 121-N of the microphones 12-1 to 12-N increase, information to be collected decreases. It is not preferred if the resolution and the information to be collected vary depending on the direction seen from the sound collection apparatuses 1 to 4. In each embodiment, the intervals between the sound collecting portions 121-1 to 121-N of adjacent microphones 12-1 to 12-N are substantially equal, and hence such variation depending on the direction can be reduced. From the above, sound in all directions can be accurately collected without increasing the size of the sound collection apparatuses 1 to 4 so much.

OTHER MODIFICATIONS, ETC.

The recess portion 111-*i* is not limited to the above. For example, in the example in FIG. 3B, the inner wall surface between the edge portion 111*a*-*i* and the edge portion 111*c*-*i* is formed into a slope shape and smoothly connected to the inner bottom surface 111*b*-*i*, but the shape of the inner wall surface between the edge portion 111*a*-*i* and the edge portion 111*c*-*i* may be a side surface shape of a circular truncated cone. In other words, the cross-sectional shape of the recess portion 111-*i* (cross-sectional shape taken along line 3B-3B) may be a trapezoid. In a fifth embodiment described later, the case where the shape of the inner wall surface between the edge portion 111*a*-*i* and the edge portion 111*c*-*i* is a side surface shape of a circular truncated cone is described in detail.

In the case where the intervals between the sound collecting portions 121-*i* of adjacent microphones 12-*i* (i=1, . . . , N) are all strictly set to be equal to each other, the sound collecting portions 121-*i* are disposed at vertices of a regular polyhedron having N vertices one by one. However, in the case where the intervals between the sound collecting portions 121-*i* are not all strictly set to be equal to each other, each sound collecting portion 121-*i* may be disposed at a position other than the vertex of the regular polyhedron. The inner bottom surface 111*b* of the sound collecting portion 121-*i* may be a curved surface rather than a flat surface.

Fifth Embodiment

A fifth embodiment is an embodiment in which the shape of the recess portion 111-*i* is formed such that the microphone 12-*i* has directivity.

Differences from the first embodiment to the fourth embodiment are mainly described below. Overlapping descriptions of the same parts as in the first embodiment to the fourth embodiment are omitted.

Example 1 of Shape of Recess Portion 111-*i*

Figure 20:
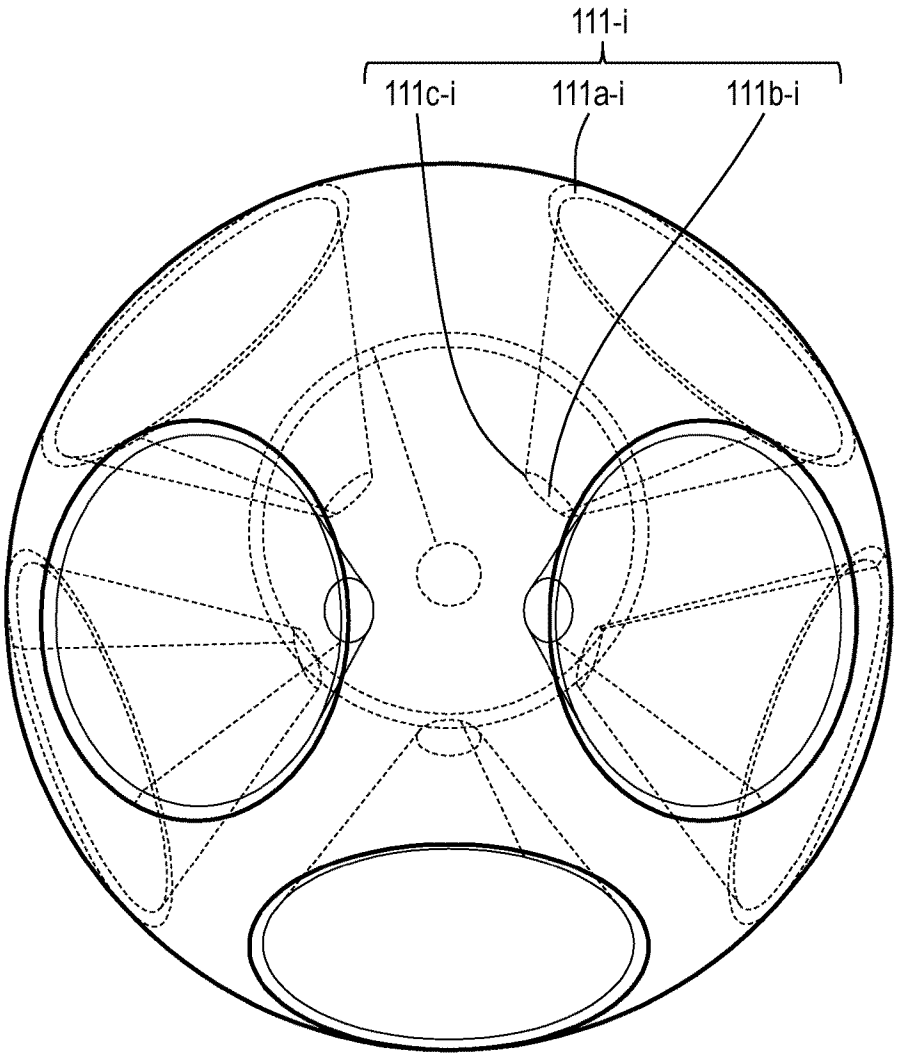
FIG. 20 is a perspective view of a sound collection apparatus when the shape of a recess portion is a substantially circular truncated cone.
Figure 21B:
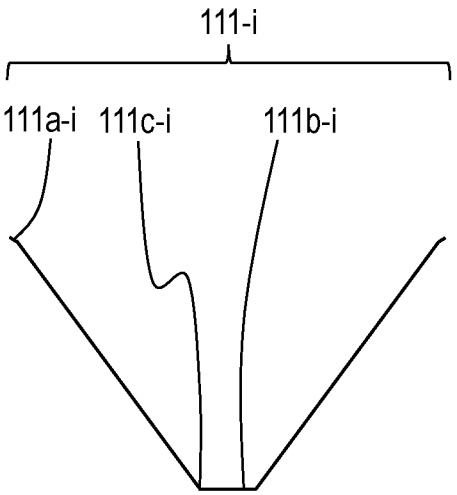
FIG. 21B is a cross-sectional view taken along the line 21B-21B in FIG. 21A.
Figure 21A:
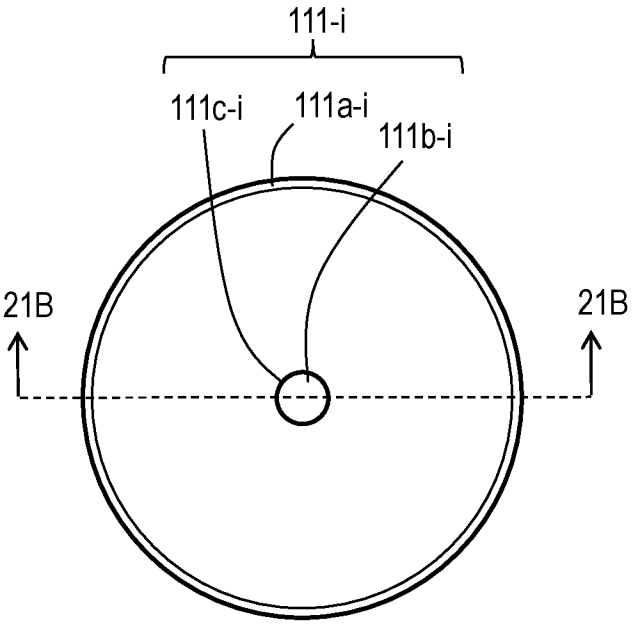
FIG. 21A is a plan view of an example of a recess portion whose shape is a substantially circular truncated cone.

As exemplified in FIG. 20, FIG. 21A, and FIG. 21B, the shape of the recess portion 111-*i* may be a substantially circular truncated cone.

As illustrated in FIG. 20, FIG. 21A, and FIG. 21B, the edge of the recess portion 111-*i* is chamfered. In the fifth embodiment, the chamfered part is an edge portion 111*a*-*i*.

FIG. 20 is a perspective view of a sound collection apparatus 1 in which the number of recess portions 111-1, . . . , 111-8 is eight and the shape of the recess portion 111-*i* is a substantially circular truncated cone.

FIG. 21A is a plan view of an example of the recess portion 111-*i* whose shape is a substantially circular truncated cone. FIG. 21B is a cross-sectional view taken along the line 21B-21B in FIG. 21A.

In this example, in the cross-sectional view of the recess portion 111-*i* in FIG. 21B, the cross section from the edge portion 111*a*-*i* to an edge portion 111*c*-*i* is linear.

Figure 22B:
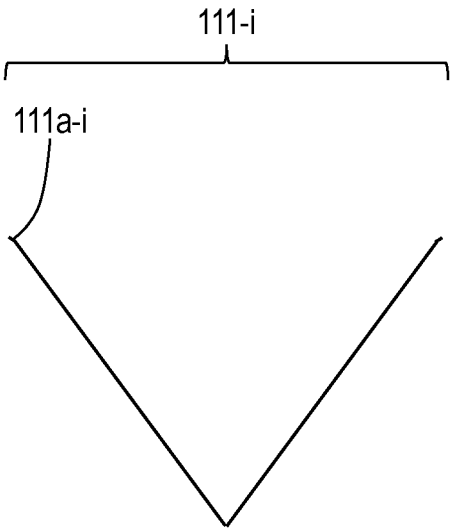
FIG. 22B is a cross-sectional view taken along the line 22B-22B in FIG. 22A.
Figure 22A:
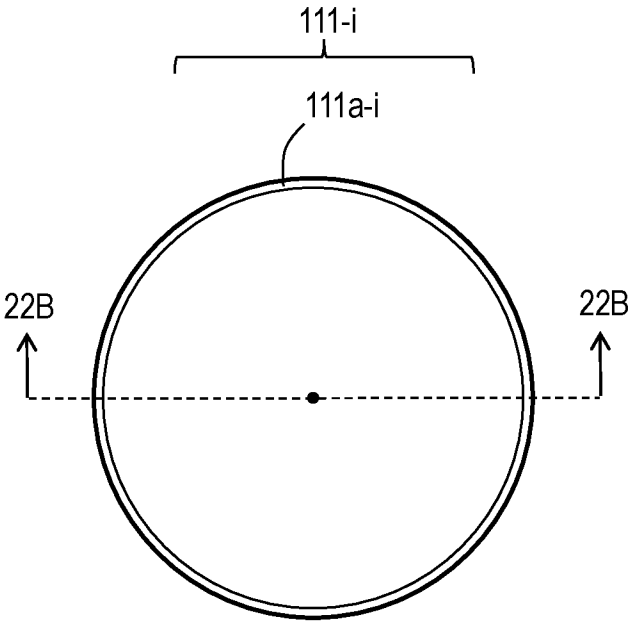
FIG. 22A is a plan view of an example of a recess portion whose shape is a substantial cone.

As exemplified in FIG. 22A and FIG. 22B, the shape of the recess portion 111-*i* may be a substantially cone. In other words, the recess portion 111-*i* is not necessarily required to have the edge portion 111*c*-*i* and the inner bottom surface 11*b*-*i*.

Note that the recess portion 111-*i* whose shape is a substantially cone and the recess portion 111-*i* whose shape is a substantially circular truncated cone may be mixed.

Example 2 of Shape of Recess Portion 111-*i*

Figure 23:
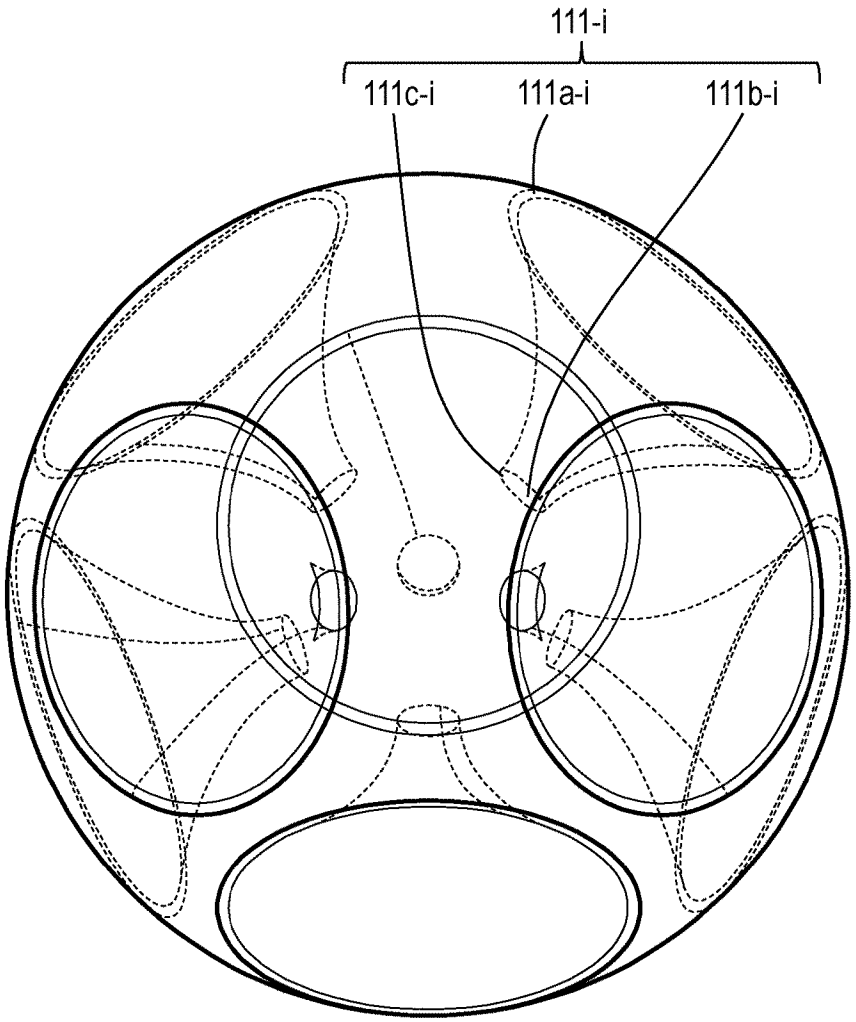
FIG. 23 is a perspective view of a sound collection apparatus when the shape of a recess portion is an exponential horn.
Figure 24B:
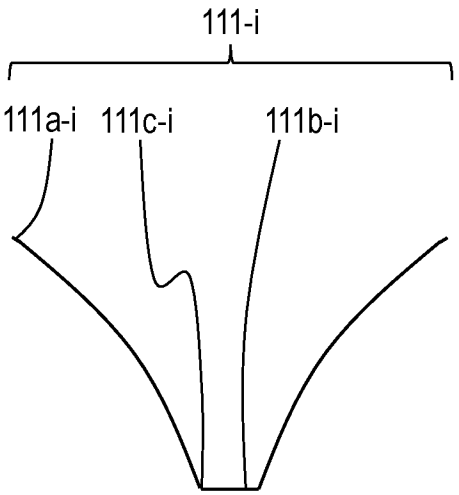
FIG. 24B is a cross-sectional view taken along the line 24B-24B in FIG. 24A.
Figure 24A:
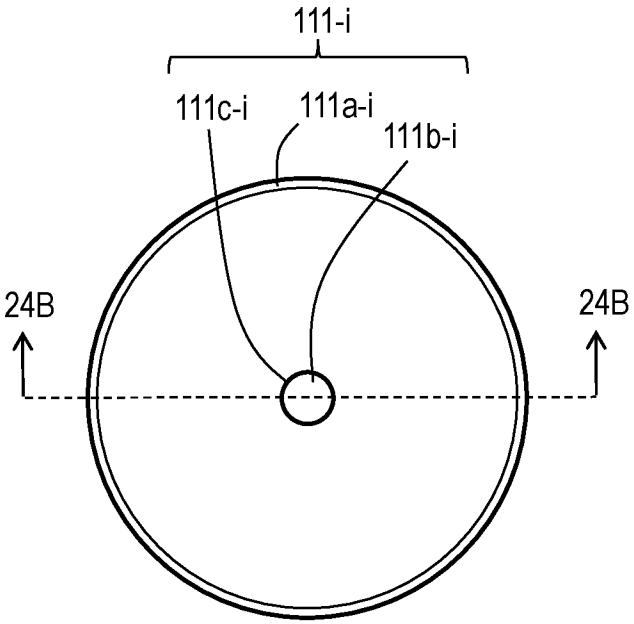
FIG. 24A is a plan view of an example of a recess portion whose shape is an exponential horn.

As exemplified in FIG. 23, FIG. 24A, and FIG. 24B, the shape of the recess portion 111-*i* may be an exponential horn. In other words, the shape of the recess portion 111-*i* may be formed such that a change rate of the diameter of the recess portion 111-*i* becomes smaller from the open end side toward the bottom surface side.

As illustrated in FIG. 23, FIG. 24A, and FIG. 24B, the edge of the recess portion 111-*i* is chamfered. Similarly to Example 1 of the shape of the recess portion 111-*i*, the chamfered part is an edge portion 111*a*-*i*.

FIG. 23 is a perspective view of a sound collection apparatus 1 in which the number of recess portions 111-1, . . . , 111-8 is eight and the shape of the recess portion 111-*i* is an exponential horn.

FIG. 24A is a plan view of an example of the recess portion 111-*i* whose shape is an exponential horn. FIG. 24B is a cross-sectional view taken along the line 24B-24B in FIG. 24A.

In this example, in the cross-sectional view of the recess portion 111-*i* in FIG. 24B, the cross section from the edge portion 111*a*-*i* to an edge portion 111*c*-*i* has a curved shape convex inward.

Example 3 of Shape of Recess Portion 111-*i*

Figure 25:
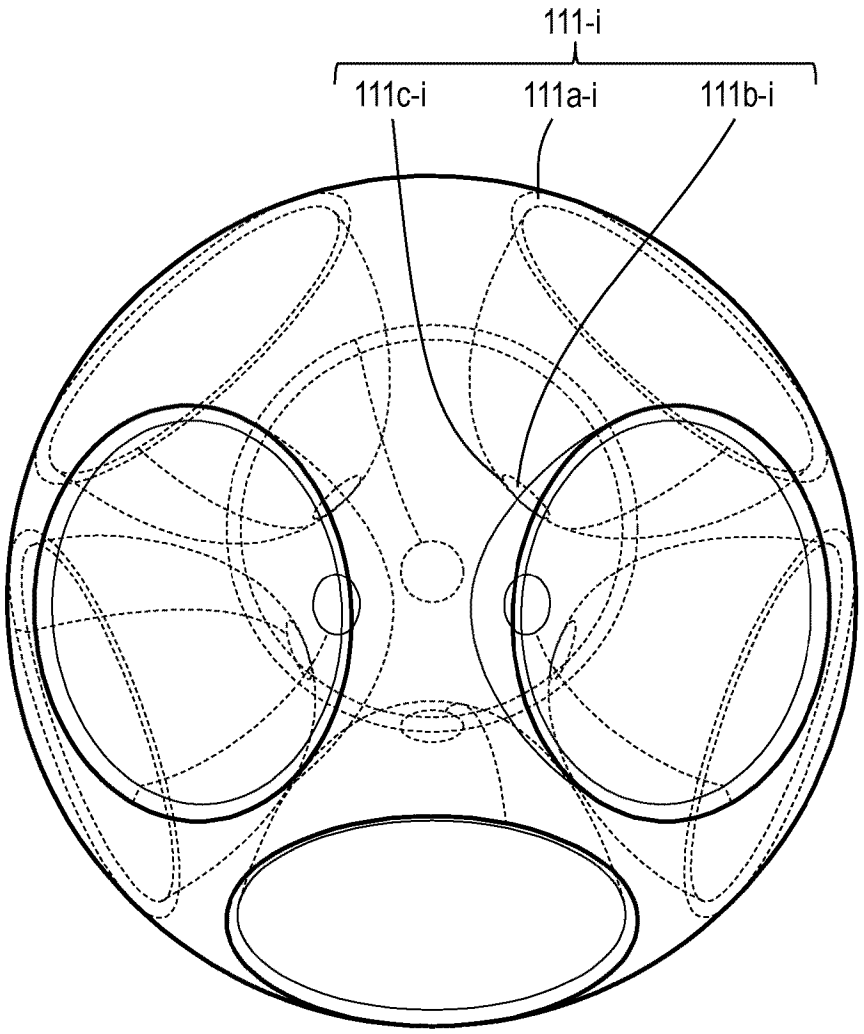
FIG. 25 is a perspective view of a sound collection apparatus when the shape of a recess portion is a bowl.
Figure 26B:
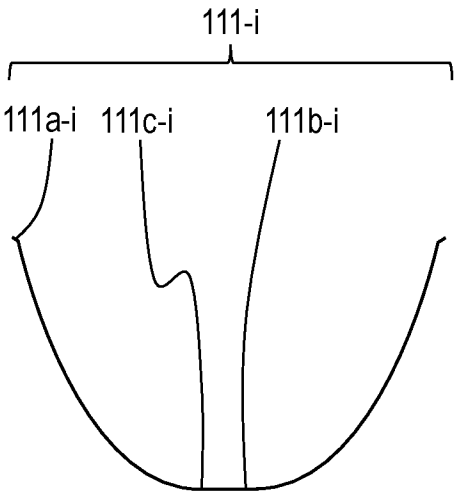
FIG. 26B is a cross-sectional view taken along the line 26B-26B in FIG. 26A.
Figure 26A:
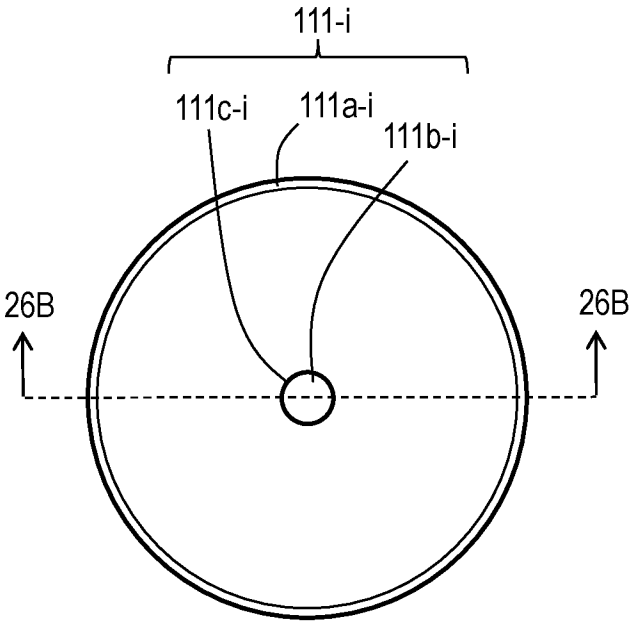
FIG. 26A is a plan view of an example of a recess portion whose shape is a bowl.

As exemplified in FIG. 25, FIG. 26A, and FIG. 26B, the shape of the recess portion 111-*i* may be a bowl. In other words, the shape of the recess portion 111-*i* may be formed such that a change rate of the diameter of the recess portion 111-*i* becomes larger from the open end side toward the bottom surface side.

As illustrated in FIG. 25, FIG. 26A, and FIG. 26B, the edge of the recess portion 111-*i* is chamfered. Similarly to Example 1 of the shape of the recess portion 111-*i*, the chamfered part is an edge portion 111*a*-*i*.

FIG. 25 is a perspective view of a sound collection apparatus 1 in which the number of recess portions 111-1, . . . , 111-8 is eight and the shape of the recess portion 111-*i* is a bowl.

FIG. 26A is a plan view of an example of the recess portion 111-*i* whose shape is a bowl. FIG. 26B is a cross-sectional view taken along the line 26B-26B in FIG. 26A.

In this example, in the cross-sectional view of the recess portion 111-*i* in FIG. 26B, the cross section from the edge portion 111*a*-*i* to an edge portion 111*c*-*i* has a curved shape convex outward.

The configuration in the fifth embodiment common to Example 1 to Example 3 of the shape of the recess portion 111-*i* is described below. In the fifth embodiment, the sound collecting portion 121-*i* of the microphone 12-*i* is installed on a straight line L passing through the center of the base or the vicinity of the center of the base and the center or substantially the center of the outer circumference or the bottom part of the recess portion 111-*i* in which the microphone 12-*i* is installed.

The sound collecting portion 121-*i* of the microphone 12-*i* is installed such that the distance between the sound collecting portion 121-*i* of the microphone 12-*i* and the center of the base is smaller than the radius of the base.

As the distance between the sound collecting portion 121-*i* of the microphone 12-*i* and the center of the base becomes smaller, the directivity of the microphone 12-*i* becomes stronger and the width of directivity of the microphone 12-*i* becomes narrower. Thus, the distance between the sound collecting portion 121-*i* of the microphone 12-*i* and the center of the base is determined as appropriate depending on the directivity required for the microphone 12-*i*.

For example, the sound collecting portion 121-*i* of the microphone 12-*i* is installed such that the distance between the sound collecting portion 121-*i* of the microphone 12-*i* and the center of the base is smaller than ½ (half) of the radius of the base.

It should be understood that the sound collecting portion 121-*i* of the microphone 12-*i* may be installed such that the distance between the sound collecting portion 121-*i* of the microphone 12-*i* and the center of the base is larger than ½ of the radius of the base.

In this manner, desired directivity of the sound collection apparatus 1 can be obtained by changing the distance between the sound collecting portion 121-*i* of the microphone 12-*i* and the center of the base.

The microphone 12-*i* may be installed so as to contact the inner bottom surface 11*b*-*i* of the recess portion 111-*i*, or may be installed so as not to contact the inner bottom surface 11*b*-*i* of the recess portion 111-*i*. When the microphone 12-*i* is installed so as not to contact the inner bottom surface 11*b*-*i* of the recess portion 111-*i*, the sound collecting portion 121-*i* of the microphone 12-*i* only needs to be installed on a straight line L passing through the center of the base or the vicinity of the center of the base and the center or substantially the center of the outer circumference or the bottom portion of the recess portion 111-*i* in which the microphone 12-*i* is installed.

The diameter of the recess portion 111-*i* is determined such that the recess portion 111-*i* does not overlap adjacent recess portions 111-*i*. For example, when the diameter of the base is 80 mm and the number of recess portions 111-1, . . . , 111-8 is eight as exemplified in FIG. 20, FIG. 23, and FIG. 25, the diameter of the recess portion 111-*i* is set to 40 mm or shorter. Note that the diameter of the recess portion 111-*i* refers to the diameter of the outer circumference of the recess portion 111-*i*.

Figure 27B:
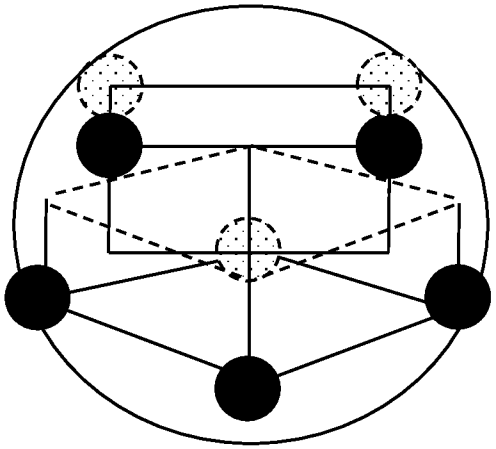
FIG. 27A and FIG. 27B are views for describing an example of the position of a recess portion.
Figure 27A:
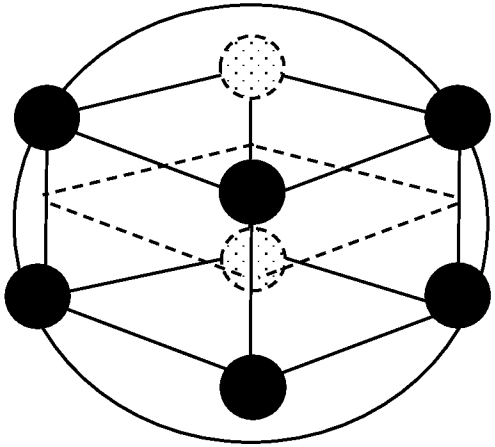

In FIG. 20, FIG. 23, and FIG. 25, the recess portions 111-1, . . . , 111-8 are provided at positions (see FIG. 27B) of eight vertices obtained by rotating a regular hexahedron having eight vertices inscribed in a sphere of the same size as the base (see FIG. 27A) by 45 degrees along a division plane, which is the plane that divides each of the four sides into two equal planes among 12 sides of the regular hexahedron, while maintaining the thus obtained upper or lower part of the regular hexahedron inscribed in the sphere.

Experiment Examples

Sound collecting portions 121-1, 121-2, and 121-3 of three microphones were provided on the surface of a base, which is a sphere with a diameter of 80 mm. The sound collecting portions 121-1 and 121-2 of the microphones are provided at positions forming an angle of 90 degrees, the sound collecting portions 121-2 and 121-3 of the microphones are provided at positions forming an angle of 90 degrees, and the sound collecting portions 121-1 and 121-3 of the microphones are provided at positions forming an angle of 180 degrees. The state in which a sound collecting portion and another sound collecting portion different from the sound collecting portion are provided at positions forming an angle of x degrees means that a straight line passing through a sound collecting portion and the center of the base and a straight line passing through another sound collecting portion and the center of the base form an angle of x degrees on a plane including both the straight lines.

Figure 28:
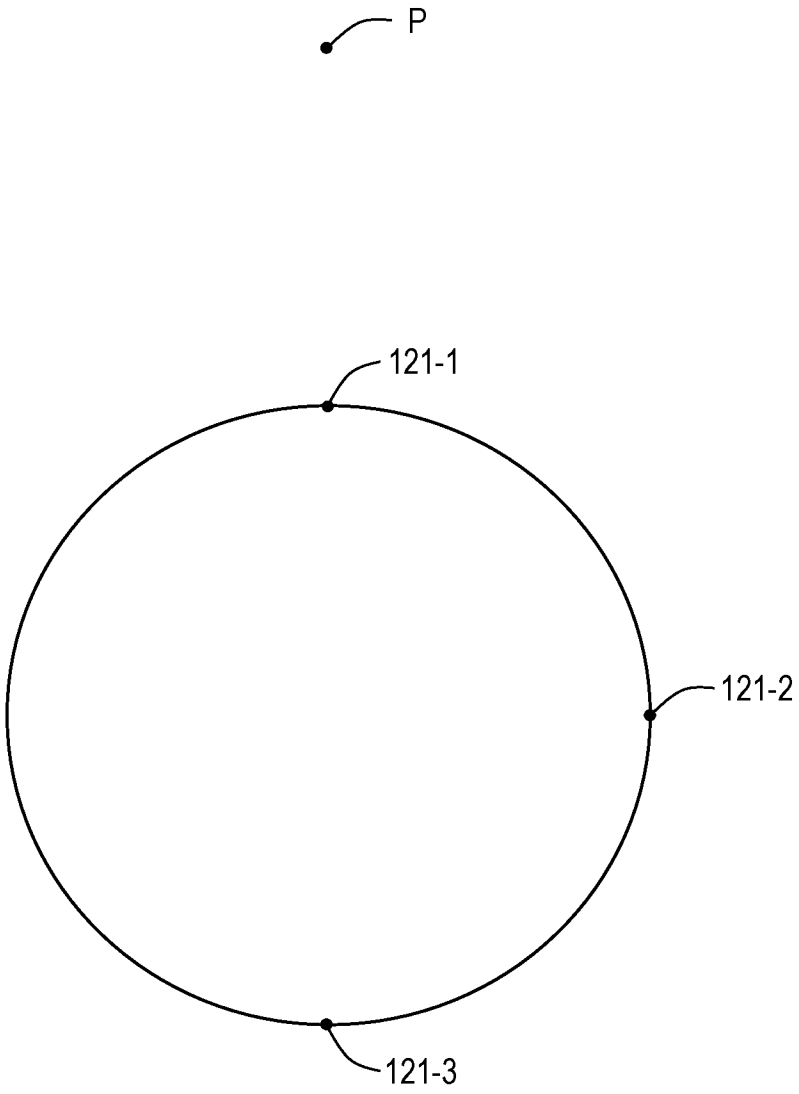
FIG. 28 is a diagram for describing the positions of sound collecting portions of microphones in an experiment example.

For example, the sound collecting portions 121-1, 121-2, and 121-3 of the microphones are provided at the positions in FIG. 28.

Sound waves of 450 Hz generated by a point sound source P at a position of 80 cm away from the microphone 12-1 are collected by each microphone. FIG. 29A illustrates impulse response of each microphone in this case.

Figure 29B:
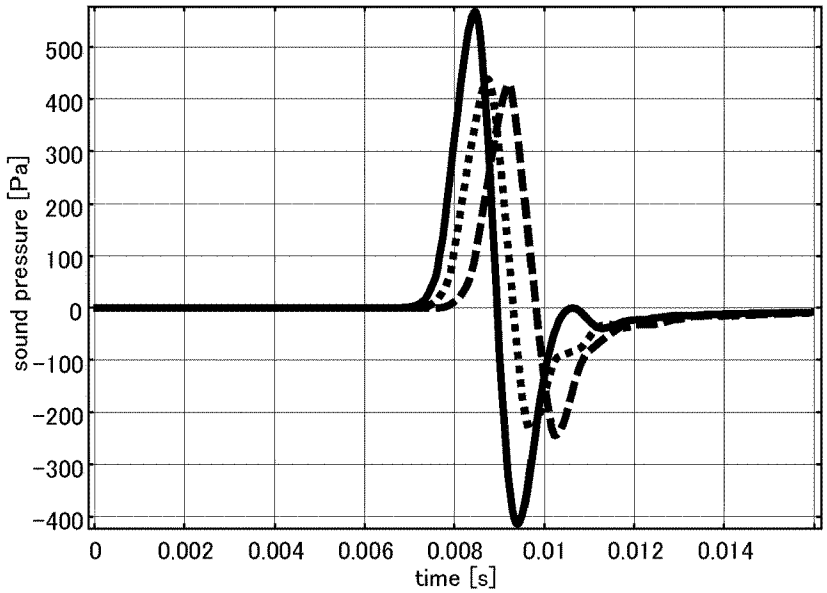
FIG. 29B is a diagram illustrating an example of impulse response when sound collecting portions of microphones are installed on inner bottom surfaces of three recess portions whose shapes are a substantially circular truncated cone on a base.
Figure 29A:
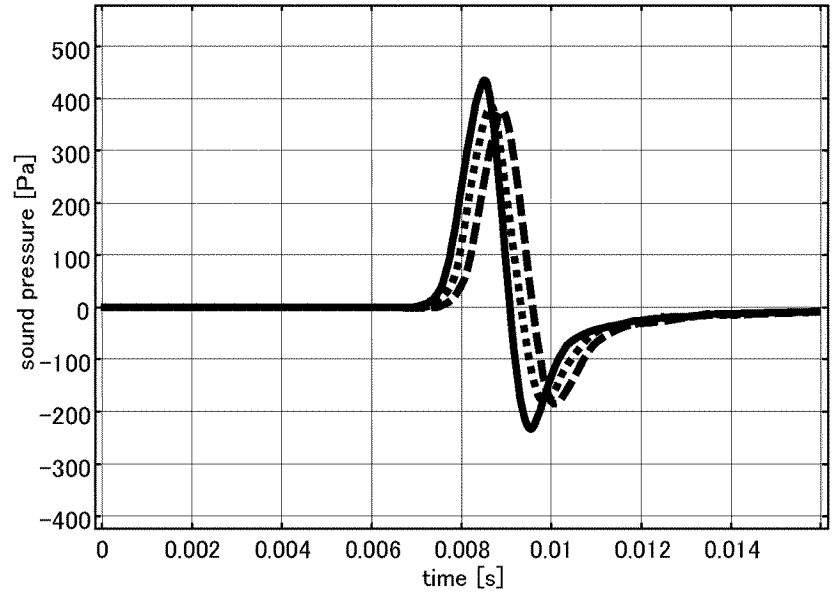
FIG. 29A is a diagram illustrating an example of impulse response when sound collecting portions of three microphones are provided on the surface of a base.

On the other hand, FIG. 29B illustrates impulse response of each microphone when the sound collecting portions 121-1, 121-2, and 121-3 of the microphones are not installed on the surface of the base but on inner bottom surfaces 11*b*-1, 11*b*-2, and 11*b*-3 of three recess portions 111-1, 111-2, and 111-3 whose shapes are a substantially circular truncated cone on the base. The depths of the recess portions 111-1, 111-2, and 111-3 are determined such that the sound collecting portions 121-1, 121-2, and 121-3 of the microphones are disposed at positions of 20 mm from the center of the base. Other experimental conditions in FIG. 29B are the same as those in FIG. 29A.

In FIG. 29A and FIG. 29B, the solid line indicates impulse response of the microphone 12-1, the dotted line indicates impulse response of the microphone 12-2, and the broken line indicates impulse response of the microphone 12-3. The same applies to other figures.

When the recess portions 111-1, 111-2, and 111-3 are provided (FIG. 29B), the difference between the maximum sound pressure of the microphone 12-1 and the maximum sound pressures of the microphones 12-2 and 12-3 is larger than that in the case in FIG. 29A.

Thus, it is understood that the directivity is higher when the recess portions 111-1, 111-2, and 111-3 are provided (FIG. 29B). Note that sound sources other than the sound source P are absent or can be ignored and hence the difference in sound pressure can be estimated as the difference in directivity.

Figure 30B:
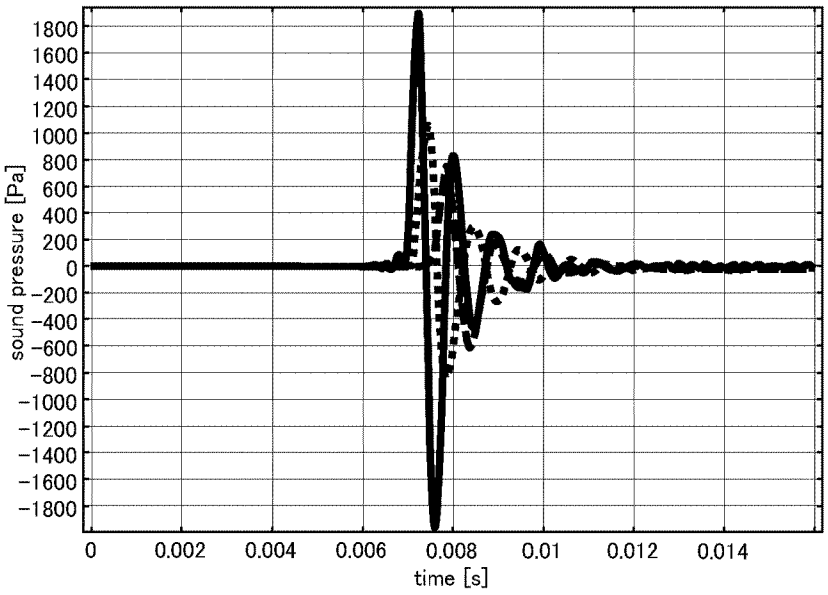
FIG. 30A and FIG. 30B are diagrams illustrating an example of impulse response when the frequency of sound waves generated from a point sound source is 1,500 Hz.
Figure 30A:
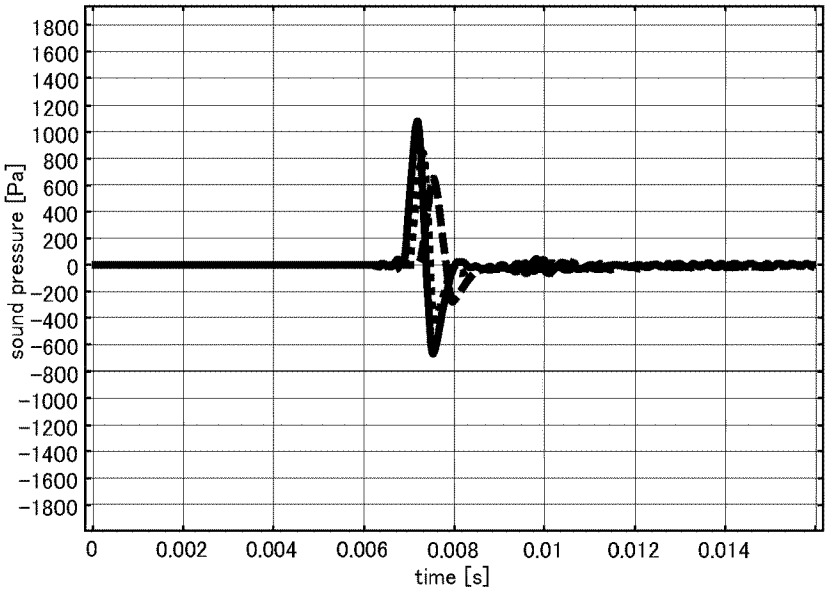

FIG. 30A and FIG. 30B illustrate impulse response of each microphone when the frequency of sound waves generated from the point sound source P is 1,500 Hz. Other experimental conditions in FIG. 30A are the same as those in FIG. 29A. Other experimental conditions in FIG. 30B are the same as those in FIG. 29B.

Even when the frequency is 1,500 Hz, similarly to the case where the frequency is 450 Hz, it is understood that the directivity is higher when the recess portions 111-1, 111-2, and 111-3 are provided (FIG. 30B).

Comparing FIG. 29B and FIG. 30B, the difference between the maximum sound pressure of the microphone 12-1 and the maximum sound pressures of the microphones 12-2 and 12-3 is larger in FIG. 30B. Thus, it can be said that higher directivity can be obtained at a higher frequency.

Figure 31:
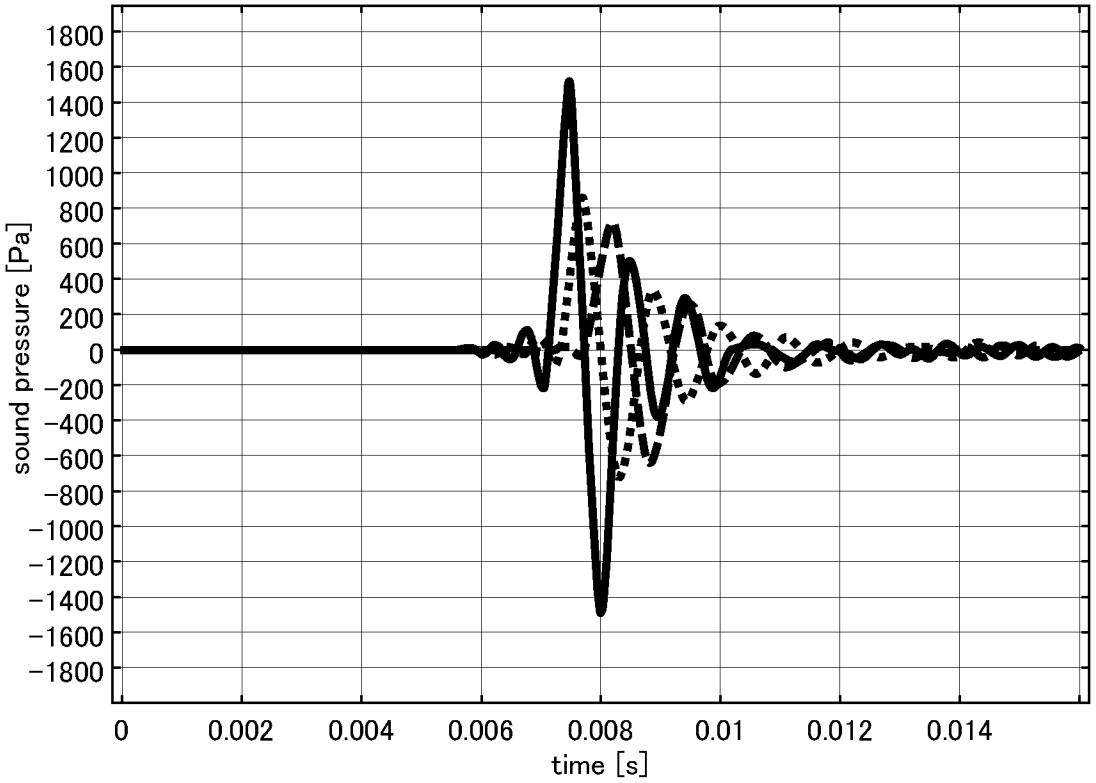
FIG. 31 is a diagram illustrating an example of impulse response when the depths of recess portions are determined such that sound collecting portions of microphones are disposed at positions of 10 mm from the center of the base.

FIG. 31 illustrates impulse response of each microphone when the depths of the recess portions 111-1, 111-2, and 111-3 are determined such that the sound collecting portions 121-1, 121-2, and 121-3 of the microphone are located at positions of 10 mm from the center of the base.

Figure 32:
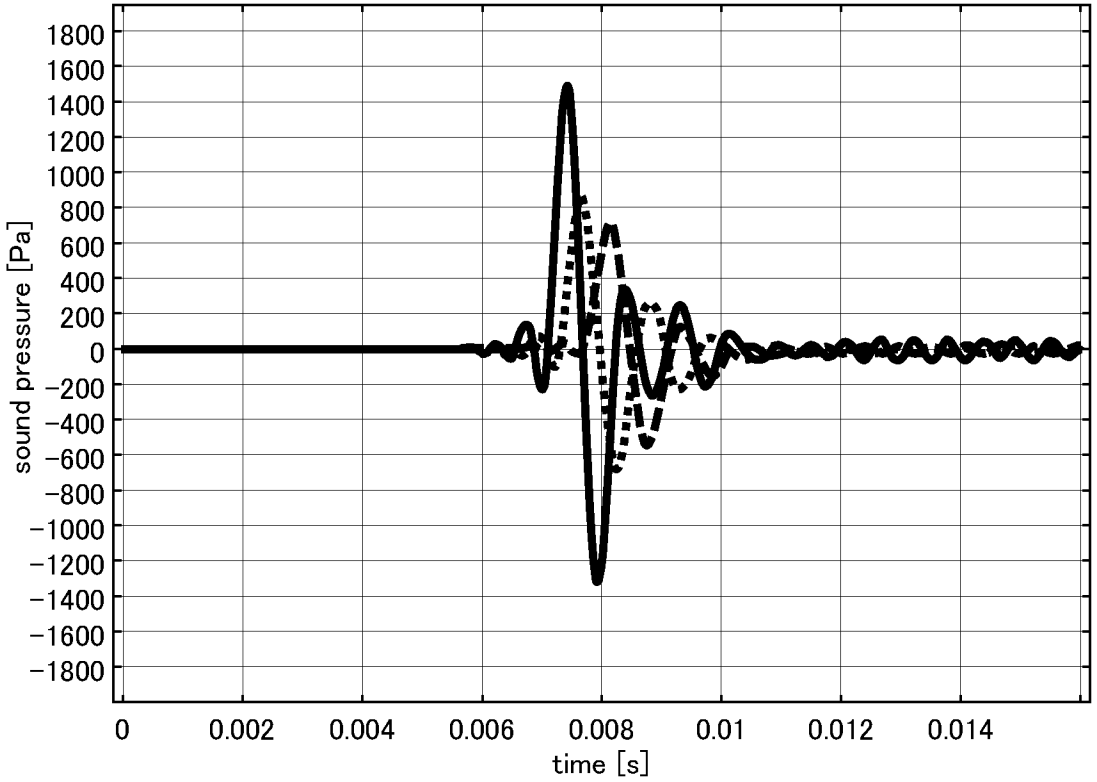
FIG. 32 is a diagram illustrating an example of impulse response when the depths of recess portions are determined such that sound collecting portions of microphones are disposed at positions of 20 mm from the center of the base.

FIG. 32 illustrates impulse response of each microphone when the depths of the recess portions 111-1, 111-2, and 111-3 are determined such that the sound collecting portions 121-1, 121-2, and 121-3 of the microphone are located at positions of 20 mm from the center of the base.

Figure 33:
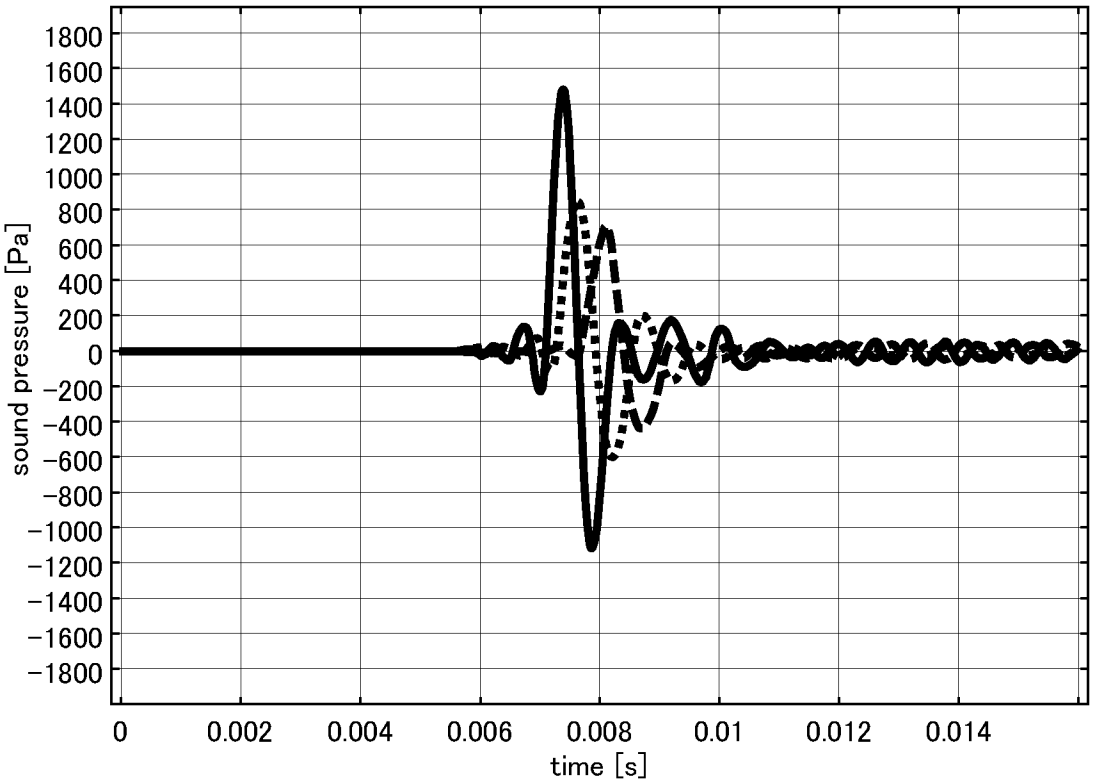
FIG. 33 is a diagram illustrating an example of impulse response when the depths of recess portions are determined such that sound collecting portions of microphones are disposed at positions of 30 mm from the center of the base.

FIG. 33 illustrates impulse response of each microphone when the depths of the recess portions 111-1, 111-2, and 111-3 are determined such that the sound collecting portions 121-1, 121-2, and 121-3 of the microphone are located at positions of 30 mm from the center of the base.

Other experimental conditions in FIG. 31 to FIG. 33 are the same as those in FIG. 29B.

In FIG. 31 to FIG. 33, the maximum sound pressures of the microphones 12-2 and 12-3 are suppressed to be lower than the maximum sound pressure of the microphone 12-1. It is understood from this that when the recess portions 111-1, 111-2, and 111-3 are provided, the directivity can be obtained irrespectively of the depths thereof.

Figure 34:
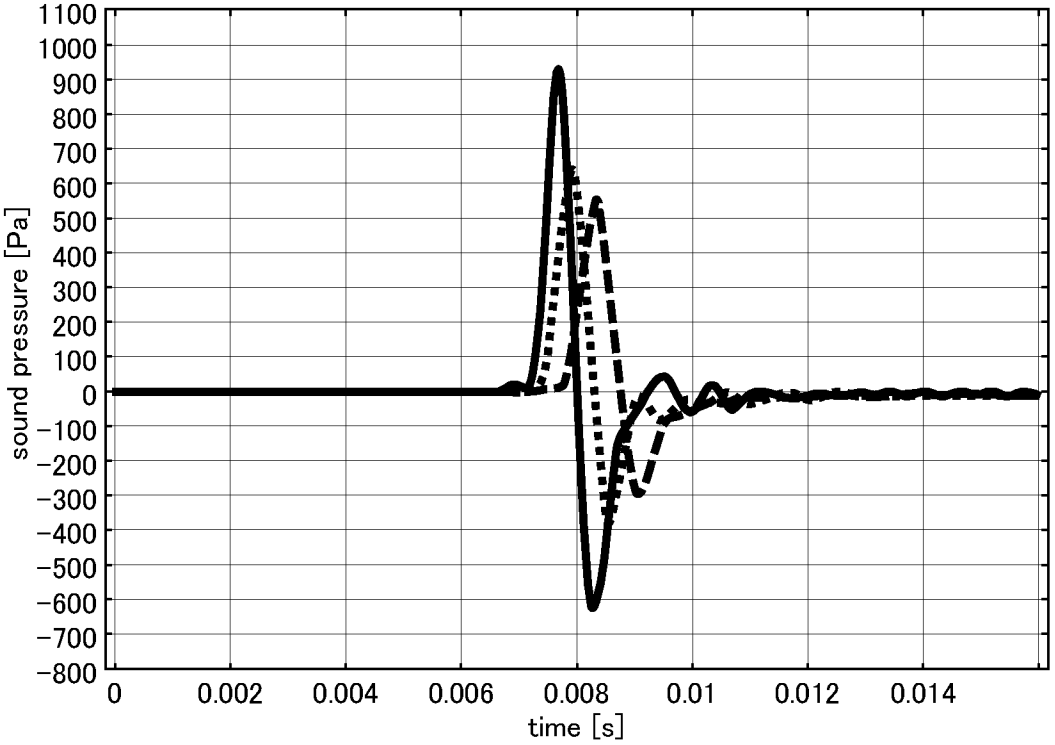
FIG. 34 is a diagram illustrating an example of impulse response when the shape of a recess portion is an exponential horn.

FIG. 34 illustrates impulse response of each microphone when the shapes of the recess portions 111-1, 111-2, and 111-3 are an exponential horn shape.

Figure 35:
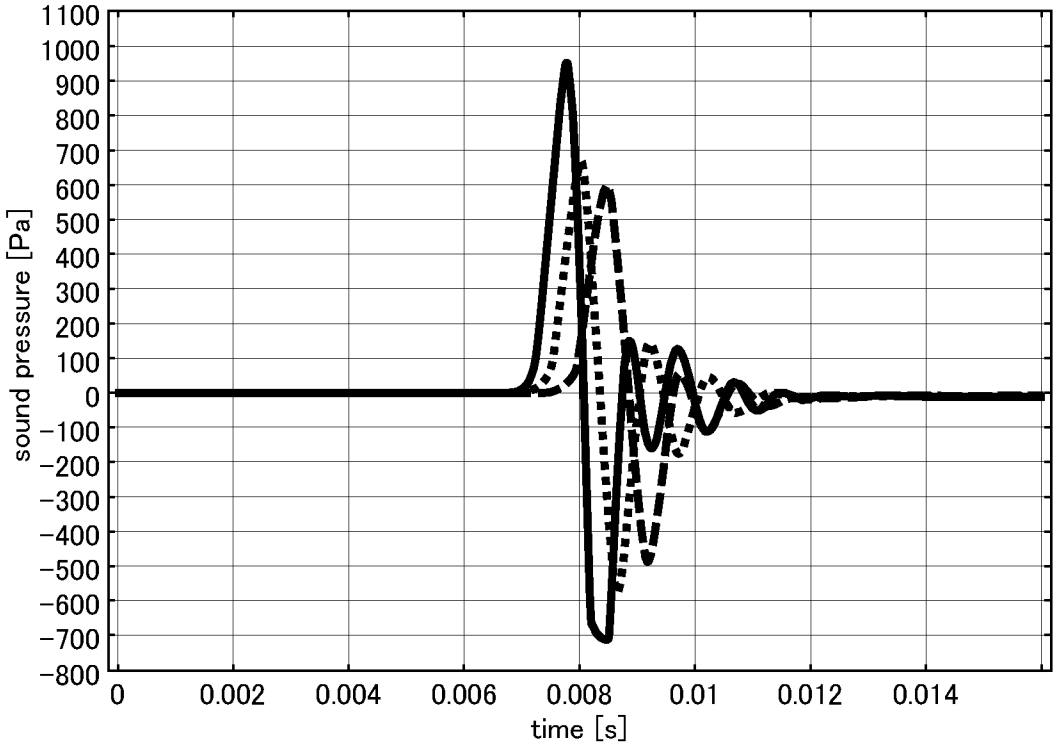
FIG. 35 is a diagram illustrating an example of impulse response when the shape of a recess portion is a bowl.

FIG. 35 illustrates impulse response of each microphone when the shapes of the recess portions 111-1, 111-2, and 111-3 are a bowl shape.

Figure 36:
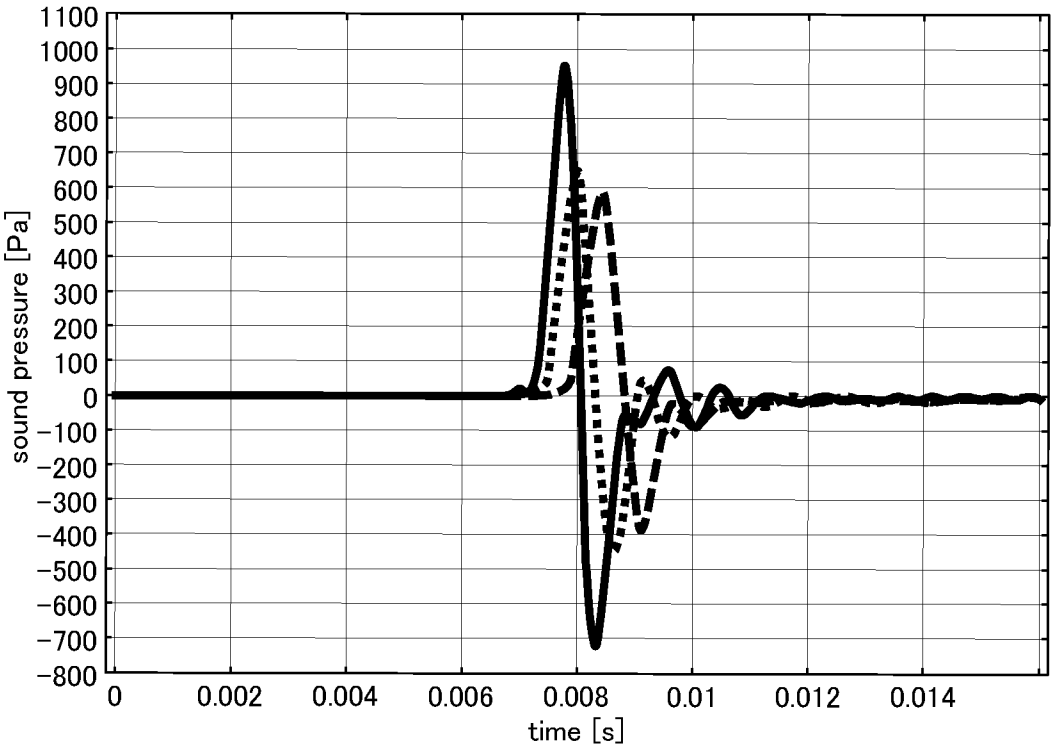
FIG. 36 is a diagram illustrating an example of impulse response when the shape of a recess portion is a substantially circular truncated cone.

FIG. 36 illustrates impulse response of each microphone when the shapes of the recess portions 111-1, 111-2, and 111-3 are a substantially circular truncated cone shape.

Other experimental conditions in FIG. 34 to FIG. 36 are the same as those in FIG. 29B.

Comparing the cases in FIG. 34 and FIG. 35, in the case in FIG. 36, the maximum sound pressures of the microphones 12-2 and 12-3 are suppressed to be relatively lower than the maximum sound pressure of the microphone 12-1. It is understood from this that when the shapes of the recess portions 111-1, 111-2, and 111-3 are a substantially circular truncated cone shape, higher directivity than that when the shapes of the recess portions 111-1, 111-2, and 111-3 are an exponential horn shape or a bowl shape can be obtained.

Modification of Fifth Embodiment

In the sound collection apparatuses 1 in the first embodiment to the fourth embodiment, the same number of N microphones 12-1, . . . , 12-N as the number of recess portions 111-1, . . . , 111-N are provided.

On the other hand, a sound collection apparatus 1 in the fifth embodiment may further has at least one microphone. In this case, each of the at least one microphone is installed in any recess portion of the N recess portions 111-1, . . . , 111-N. In other words, two or more microphones may be provided in at least one recess portion of the recess portions 111-1, . . . , 111-N.

REFERENCE SIGNS LIST

1 to 4 sound collection apparatus
11 to 41 base
111-*i* recess portion
12-*i* microphone
121-*i* sound collecting portion

The invention claimed is:

1. A sound collection apparatus, comprising: a substantially spherical base on which at least N recess portions are provided in a surface thereof with a predetermined interval therebetween; and N microphones, wherein N is an integer of 2 or greater, the microphones are installed on an inner bottom surface side of the recess portions one by one, and intervals between the sound collecting portions of adjacent microphones are substantially equal; and a rod-shaped support member fixed to the base while passing through the base, wherein N is 2, a sound collecting portion of the microphone is disposed on a first straight line passing through a center of the base or a vicinity of the center of the base, and the support member is disposed on a second straight line passing through the center of the base or the vicinity of the center of the base and substantially orthogonal to the first straight line, or N is any one of 6, 8, 12, and 20, the sound collecting portions of the microphones are disposed at vertices of a regular polyhedron having N vertices or in vicinities of the vertices one by one, and the support member is disposed on a third straight line passing through centers of a pair of parallel faces of the regular polyhedron or vicinities of the centers of the pair of faces.

2. The sound collection apparatus according to claim 1, wherein a shape of an edge portion of the recess portion on an open end side is a substantially circle, and an inner bottom surface of the recess portion is a substantially flat surface of a substantially circle, and a sound collecting portion of the microphone is disposed at a center of an inner bottom surface of the recess portion or in a vicinity of the center of the inner bottom surface.

3. The sound collection apparatus according to claim 1, wherein a shape of an edge portion of the recess portion on an open end side is a substantially circle, and a depth of the recess portion is less than a half of a diameter of an edge portion of an open end of the recess portion.

4. The sound collection apparatus according to claim 1, wherein the N recess portions all have substantially the same shape.

5. The sound collection apparatus according to claim 1, wherein N is 2, and a sound collecting portion of the microphone is disposed on a straight line passing through a center of the base or a vicinity of the center of the base, or N is any one of 4, 6, 8, 12, and 20, and the sound collecting portions of the microphones are disposed at vertices of a regular polyhedron having N vertices or in vicinities of the vertices one by one.

6. The sound collection apparatus according to claim 1, comprising a support member that supports the base from a lower side, wherein the support member supports a support region located on a lower side of the base, and intervals between the support region and the sound collecting portions of the microphones adjacent to the support region are substantially uniform.

7. The sound collection apparatus according to claim 1, wherein a shape of the recess portion is a substantially corn or a substantially circular truncated cone.

8. The sound collection apparatus according to claim 7, wherein the microphone is installed such that a distance between the sound collecting portion of the microphone and the center of the base is smaller than a half of a radius of the base.

9. The sound collection apparatus according to claim 8, wherein the sound collecting portions of the microphones are disposed on a straight line passing through a center of the base or a vicinity of the center of the base and a center or substantially the center of an outer circumference or a bottom portion of a recess portion in which the sound collecting portion of the microphone is installed.

* * * * *